US008130054B1

(12) United States Patent
Martin et al.

(10) Patent No.: US 8,130,054 B1
(45) Date of Patent: Mar. 6, 2012

(54) FREQUENCY-ADJUSTABLE RADIO FREQUENCY ISOLATOR CIRCUITRY

(75) Inventors: Tracy Scott Martin, Phoenix, AZ (US); Ruediger Bauder, Feldkirchen-Westerham (DE); Erin Spivey, Chandler, AZ (US)

(73) Assignee: RF Micro Devices, Inc., Greensboro, NC (US)

( * ) Notice: Subject to any disclaimer, the term of this patent is extended or adjusted under 35 U.S.C. 154(b) by 308 days.

(21) Appl. No.: 12/578,924

(22) Filed: Oct. 14, 2009

Related U.S. Application Data

(60) Provisional application No. 61/105,221, filed on Oct. 14, 2008.

(51) Int. Cl.
*H01P 1/36* (2006.01)
*H01P 5/04* (2006.01)

(52) U.S. Cl. ..... 333/24 R; 333/24.2; 333/1.1

(58) Field of Classification Search ..... 333/24 R, 333/24.1, 24.2, 1.1
See application file for complete search history.

(56) References Cited

U.S. PATENT DOCUMENTS 3,716,729 A * 2/1973 Rollett ..... 327/555
3,723,772 A * 3/1973 Collom ..... 327/396
5,821,830 A 10/1998 Hasegawa
6,940,360 B2 * 9/2005 Takeda et al. ..... 333/24.2
7,265,643 B2 * 9/2007 Toncich ..... 333/24.2

OTHER PUBLICATIONS

Hasegawa, Takashi et al., "Low loss two-port lumped element isolator using improved gyrator circuit," 2005 IEEE MTT-S International Microwave Symposium Digest, Jun. 12-17, 2005, pp. 339-342, IEEE.

Hasegawa, Takashi et al., "Low Loss Lumped Element Isolator Using Gyrator Circuit With Two Asymmetrical Electrodes," IEEE MTT-S International Microwave Symposium Digest, Nov. 16, 2006, pp. 540-543, IEEE.

Knerr, R. H., "A Proposed Lumped-Element Switching Circulator Principle," IEEE Transactions on Microwave Theory and Techniques, Jun. 1972, pp. 396-401, vol. 20, No. 6, IEEE.

* cited by examiner

*Primary Examiner* — Dean O Takaoka
(74) *Attorney, Agent, or Firm* — Withrow & Terranova, P.L.L.C.

(57) ABSTRACT

The present invention relates to a frequency-adjustable radio frequency (RF) isolator that may operate as a bandpass filter when processing RF signals in a forward direction and may operate as a notch filter when processing RF signals in a reverse direction. The notch filter has a notch frequency, which is adjustable to provide adequate isolation from reflected signals at a specific operating frequency. The frequency-adjustable RF isolator may include an electro-magnetic gyrator coupled to a variable impedance circuit, which may present a variable impedance to the electro-magnetic gyrator. The notch frequency may be dependent on the variable impedance. The notch filter may be a single-notch filter or may be a multiple-notch filter.

22 Claims, 24 Drawing Sheets

FREQUENCY-ADJUSTABLE RADIO FREQUENCY ISOLATOR CIRCUITRY

This application claims the benefit of provisional patent application Ser. No. 61/105,221, filed Oct. 14, 2008, the disclosure of which is hereby incorporated herein by reference in its entirety.

FIELD OF THE INVENTION

Embodiments of the present invention relate to radio frequency (RF) isolators, which may be used in RF communications equipment.

BACKGROUND OF THE INVENTION

A radio frequency (RF) isolator is one example of an RF circuit having a non-reciprocal response. In an ideal RF isolator, RF signals may be allowed to pass in a forward direction and may be completely blocked in a reverse direction. However, practical RF isolators have an insertion loss in the forward direction and a return loss in the reverse direction, which may have a non-uniform frequency response. The RF isolator may be used between a power amplifier and a transmitting antenna to pass transmitted signals from the power amplifier and block reflected signals coming back from the antenna due to impedance mismatch issues, such as antenna loading effects. In a portable wireless device, such as a cell phone, a wireless personal digital assistant (PDA), or the like, antenna loading conditions may be unpredictable and subject to frequent changes, which may cause antenna reflections. By isolating the power amplifier from the antenna reflections, output power stability from the power amplifier may be improved.

An RF isolator that is based on a gyrator, such as one of a Murata CES30 Series, may operate as a bandpass filter in the forward direction and as a single-notch filter in the reverse direction. The single-notch filter has a notch frequency at which the notch filter provides its maximum isolation. As long as the power amplifier is transmitting at or near the notch frequency, the RF isolator may provide adequate isolation from reflected signals. However, some portable wireless devices may be multi-mode devices, which may operate using two or more RF communications bands with wide frequency separation from one another. The RF isolator may provide inadequate isolation for such devices. An RF isolator based on a gyrator, such as another of the Murata CES30 Series, may operate as a dual-notch filter in the reverse direction. The dual-notch filter has a first notch frequency and a second notch frequency. A reverse isolation band spans the frequencies between the first and second notch frequencies, and the reverse isolation band may span two or more RF communications bands. However, the isolation provided by a dual-notch RF isolator in its reverse isolation band may be significantly less than the isolation provided by a single-notch RF isolator at its notch frequency. The isolation provided by the dual-notch RF isolator in its reverse isolation band may be inadequate. Thus, there is a need for an RF isolator that can provide reverse isolation over a wide frequency range with isolation that is equivalent to a single-notch RF isolator at its notch frequency.

SUMMARY OF THE EMBODIMENTS

The present invention relates to a frequency-adjustable radio frequency (RF) isolator that may operate as a bandpass filter when processing RF signals in a forward direction and may operate as a notch filter when processing RF signals in a reverse direction. The notch filter has a notch frequency, which is adjustable to provide adequate isolation from reflected signals at a specific operating frequency. The frequency-adjustable RF isolator may include an electro-magnetic gyrator coupled to a variable impedance circuit, which may present a variable impedance to the electro-magnetic gyrator. The notch frequency may be dependent on the variable impedance. The notch filter may be a single-notch filter or a multiple-notch filter.

In one embodiment of the present invention, the notch frequency may be selected to match a specific transmit frequency. The specific transmit frequency may be within any of multiple RF communications bands. The notch frequency may be RF transmit channel specific and may be changed each time a transmitter changes RF transmit channels. In another embodiment of the present invention, when transmitting within an RF communications band, the notch frequency is adjusted to be at about the center of the RF communications band. The notch filter may provide adequate isolation at edges of the RF communications band. The notch frequency may change only when transmitting within another RF communications band.

The notch frequency may be selected by switching one or more reactive components into or out of the variable impedance circuit. The variable impedance circuit may include one or more resistive element, one or more capacitive element, one or more inductive element, one or more switching element, or any combination thereof. The one or more switching element may include a micro-electro-mechanical systems (MEMS) switch, a field effect transistor (FET) element, a positive-intrinsic-negative (PIN) diode, or any combination thereof. The variable impedance circuit may include a variable impedance device, such as a varactor diode, which has its impedance selected by a bias voltage or current.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention relates to a frequency-adjustable radio frequency (RF) isolator that may operate as a bandpass filter when processing RF signals in a forward direction and may operate as a notch filter when processing RF signals in a reverse direction. The notch filter has a notch frequency, which is adjustable to provide adequate isolation from reflected signals at a specific operating frequency. The frequency-adjustable RF isolator may include an electro-magnetic gyrator coupled to a variable impedance circuit, which may present a variable impedance to the electro-magnetic gyrator. The notch frequency may be dependent on the variable impedance. The notch filter may be a single-notch filter or a multiple-notch filter.

In one embodiment of the present invention, the notch frequency may be selected to match a specific transmit frequency. The specific transmit frequency may be within any of multiple RF communications bands. The notch frequency may be RF transmit channel specific and may be changed each time a transmitter changes RF transmit channels. In another embodiment of the present invention, when transmitting within an RF communications band, the notch frequency is adjusted to be at about the center of the RF communications band. The notch filter may provide adequate isolation at edges of the RF communications band. The notch frequency may change only when transmitting within another RF communications band.

The notch frequency may be selected by switching one or more reactive components into or out of the variable impedance circuit. The variable impedance circuit may include one or more resistive element, one or more capacitive element, one or more inductive element, one or more switching element, or any combination thereof. The one or more switching element may include a micro-electro-mechanical systems (MEMS) switch, a field effect transistor (FET) element, a positive-intrinsic-negative (PIN) diode, or any combination thereof. The variable impedance circuit may include a variable impedance device, such as a varactor diode, which has its impedance selected by a bias voltage or current.

Figure 1:
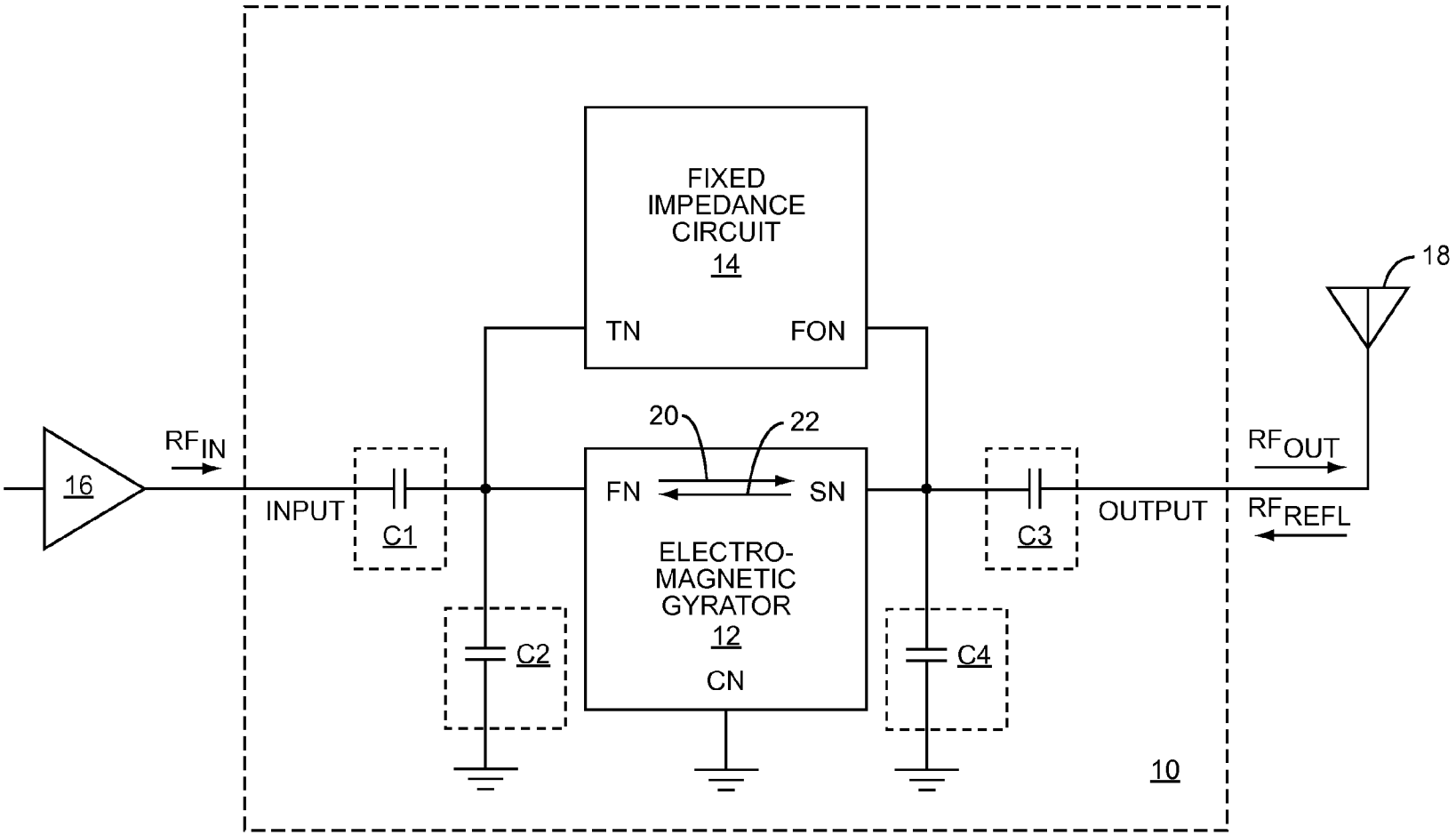
FIG. 1 PRIOR ART
FIG. 1 shows a single-notch radio frequency (RF) isolator circuit, according to the prior art.

FIG. 1 shows a single-notch RF isolator circuit 10, according to the prior art. The single-notch RF isolator circuit 10 includes an electro-magnetic gyrator 12, a fixed impedance circuit 14, a first capacitive element C1, a second capacitive element C2, a third capacitive element C3, a fourth capacitive element C4, an RF input INPUT, and an RF output OUTPUT. The electro-magnetic gyrator 12 has a first node FN, a second node SN, and a common node CN, which is coupled to ground. The fixed impedance circuit 14 has a third node TN and a fourth node FON. The first capacitive element C1 is coupled between the RF input INPUT and the first node FN. The second capacitive element C2 is coupled between the first node FN and ground. The third node TN is coupled to the first node FN. The third capacitive element C3 is coupled between the RF output OUTPUT and the second node SN. The fourth capacitive element C4 is coupled between the second node SN and ground. The fourth node FON is coupled to the second node SN.

An output of an amplifier 16, such as a power amplifier, provides an RF input signal $RF_{IN}$ to the RF input INPUT, and the RF output OUTPUT provides an RF output signal $RF_{OUT}$ to an antenna 18 based on the RF input signal $RF_{IN}$. A reflection of the RF output signal $RF_{OUT}$ is called a reflected RF signal $RF_{REFL}$ and may be fed into the RF output OUTPUT. The reflected RF signal $RF_{REFL}$ may be based on one or more impedance mismatch between the RF output OUTPUT and the antenna 18, an antenna impedance mismatch due to antenna characteristics, an antenna impedance mismatch due to antenna loading conditions, or any combination thereof. When processing RF signals in a forward direction 20, the electro-magnetic gyrator 12 provides processed RF signals from the second node SN based on the first node FN, and when processing RF signals in a reverse direction 22, the electro-magnetic gyrator 12 provides processed RF signals from the first node FN based on the second node SN.

When processing RF signals in the forward direction 20, the electro-magnetic gyrator 12 may operate as a bandpass filter, such that any RF signals falling within a passband of the bandpass filter may be forwarded from the first node FN to the second node SN with an insertion loss, which is dependent on response characteristics of the bandpass filter. When processing RF signals in the reverse direction 22, the electro-magnetic gyrator 12 may operate as a single-notch filter having a notch frequency, such that any RF signals having the notch frequency or nearly the notch frequency may be attenuated and forwarded from second node SN to the first node FN with a return loss, which is dependent on response characteristics of the single-notch filter. The first and the third capacitive elements C1, C3 may alternating current (AC) couple the output of the amplifier 16 to the RF input INPUT and may AC couple the RF output OUTPUT to the antenna 18, respectively. The response characteristics of the bandpass filter, the response characteristics of the single-notch filter, or both, may be based on the first, the second, the third, the fourth capacitive elements C1, C2, C3, C4, an impedance presented to the third and fourth nodes TN, FON of the fixed impedance circuit 14, or any combination thereof.

Figure 2:
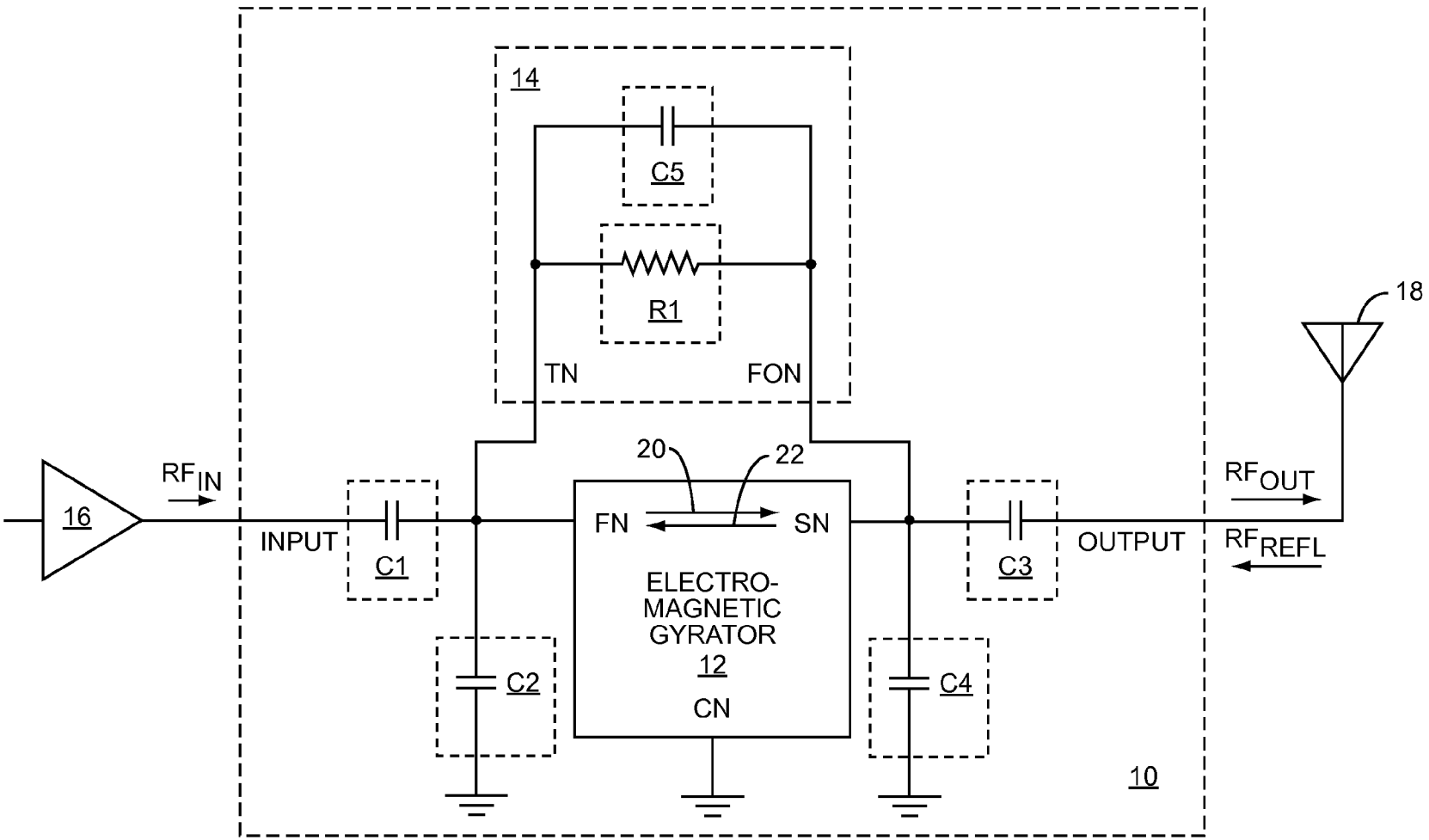
FIG. 2 PRIOR ART
FIG. 2 shows details of a fixed impedance circuit illustrated in FIG. 1.

FIG. 2 shows details of the fixed impedance circuit 14 illustrated in FIG. 1. The fixed impedance circuit 14 includes a first resistive element R1 coupled between the third node TN and the fourth node FON and a fifth capacitive element C5 coupled between the third node TN, and the fourth node FON. The notch frequency of the single-notch filter may be based on the first, the second, the third, the fourth, the fifth capacitive elements C1, C2, C3, C4, C5, or any combination thereof. When processing RF signals in the forward direction 20, the electro-magnetic gyrator 12 may apply about zero phase-shift to the processed RF signals. When processing RF signals in the reverse direction 22, the electro-magnetic gyrator 12 may apply a phase-shift to the processed RF signals. At the notch frequency, the applied phase-shift may be equal to about 180 degrees, such that the processed RF signals in the reverse direction 22 may appear across the first resistive element R1 and be dissipated. At frequencies other than the notch frequency, the applied phase-shift may be less than 180 degrees, such that the processed RF signals in the reverse direction 22 may not be reduced as effectively as processed RF signals at the notch frequency.

Figure 3:
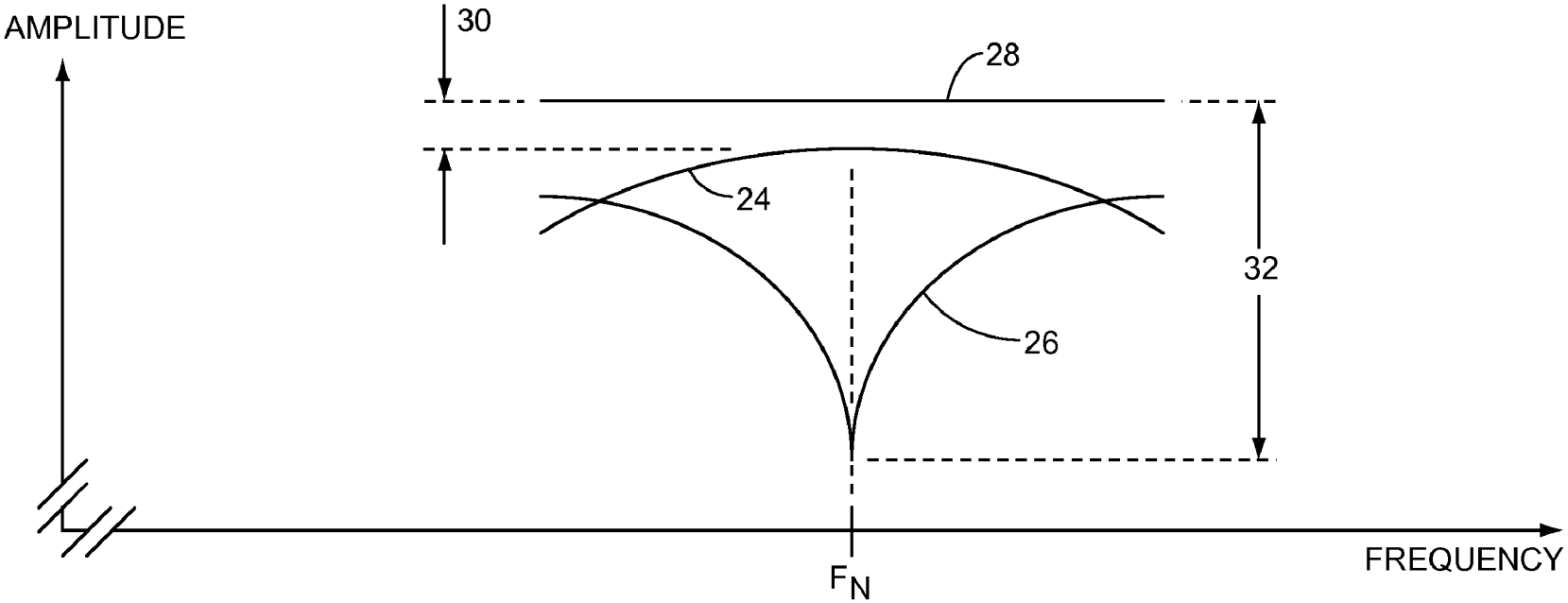
FIG. 3 PRIOR ART
FIG. 3 is a graph showing a forward direction frequency response and a reverse direction frequency response of the single-notch RF isolator circuit illustrated in FIG. 1.

FIG. 3 is a graph showing a forward direction frequency response 24 and a reverse direction frequency response 26 of the single-notch RF isolator circuit 10 illustrated in FIG. 1. A zero decibel (db) reference line 28 is shown for clarity. The forward direction frequency response 24 may approximate a bandpass filter response and may have an insertion loss 30 at a notch frequency $F_N$. The insertion loss 30 is the difference between the zero db reference line 28, which is indicative of a magnitude of the RF input signal $RF_{IN}$, and the forward direction frequency response 24, which is indicative of a magnitude of the RF output signal $RF_{OUT}$, at the notch frequency $F_N$. The reverse direction frequency response 26 may approximate a single-notch filter response and may have a return loss 32 at the notch frequency $F_N$. The return loss 32 is the difference between the zero db reference line 28, which is indicative of a magnitude of the reflected RF signal $RF_{REFL}$, and the reverse direction frequency response 26, which is indicative of a magnitude of a processed reflected RF signal (not shown), at the notch frequency $F_N$. The insertion loss 30 and the return loss 32 may be useful in evaluating the effectiveness of the single-notch RF isolator circuit 10. Generally, a low insertion loss 30 may be desirable since the insertion loss 30 is indicative of how much of an RF transmit signal is lost in the single-notch RF isolator circuit 10. A high return loss 32 may be desirable since the return loss 32 is indicative of effectiveness at blocking reflected RF signals.

Figure 4:
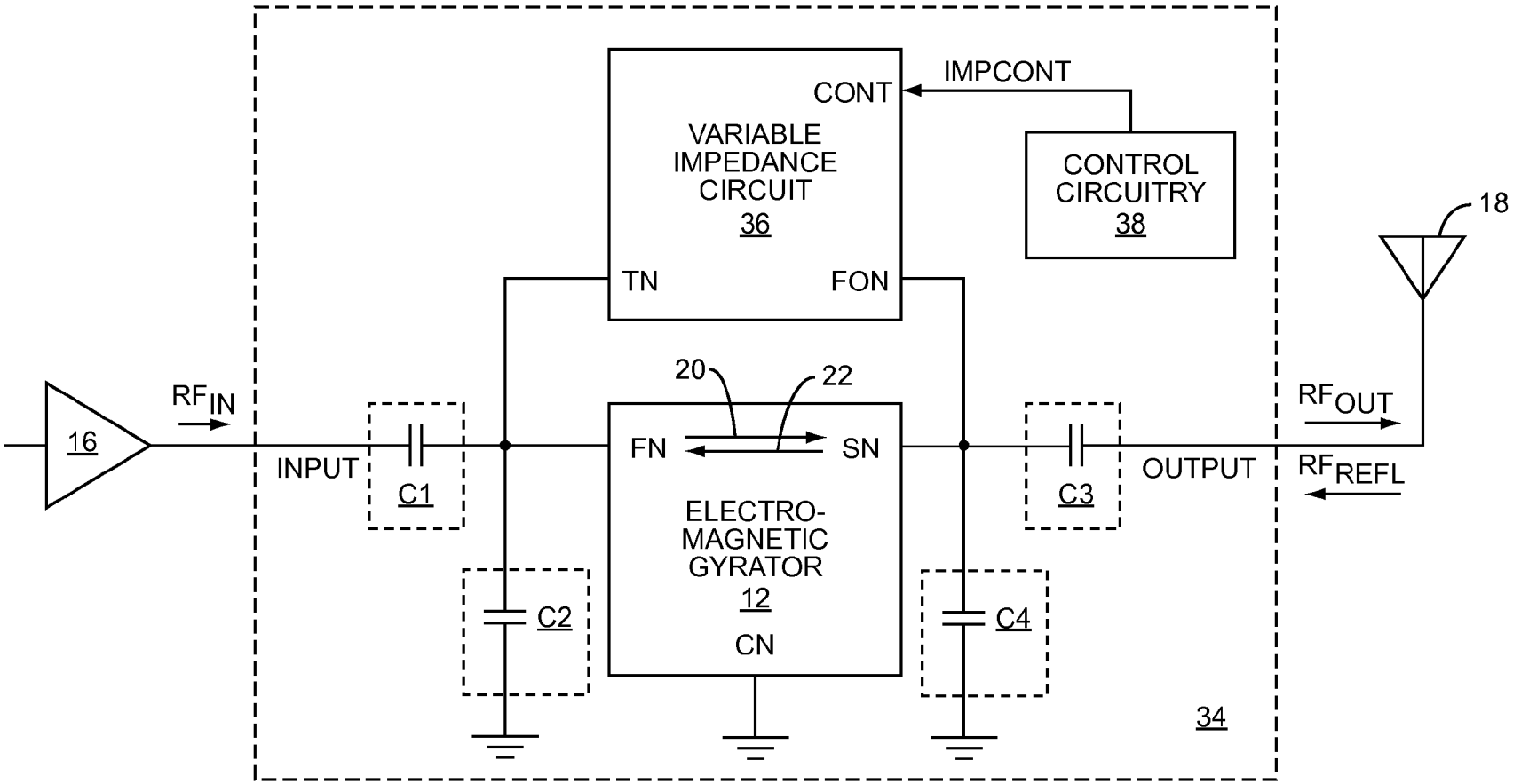
FIG. 4 shows a frequency-adjustable RF isolator circuit, according to one embodiment of the present invention.

FIG. 4 shows a frequency-adjustable RF isolator circuit 34, according to one embodiment of the present invention. The frequency-adjustable RF isolator circuit 34 includes the electro-magnetic gyrator 12, a variable impedance circuit 36, control circuitry 38, the first capacitive element C1, the second capacitive element C2, the third capacitive element C3, the fourth capacitive element C4, the RF input INPUT, and the RF output OUTPUT. The electro-magnetic gyrator 12 has the first node FN, the second node SN, and the common node CN, which is coupled to ground. The variable impedance circuit 36 has the third node TN, the fourth node FON, and a control node CONT. The first capacitive element C1 is coupled between the RF input INPUT and the first node FN. The second capacitive element C2 is coupled between the first node FN and ground. The third node TN is coupled to the first node FN. The third capacitive element C3 is coupled between the RF output OUTPUT and the second node SN. The fourth capacitive element C4 is coupled between the second node SN and ground. The fourth node FON is coupled to the second node SN. The control circuitry 38 provides an impedance control signal IMPCONT to the control node CONT.

An output of the amplifier 16, such as a power amplifier, provides the RF input signal $RF_{IN}$ to the RF input INPUT, and the RF output OUTPUT provides the RF output signal $RF_{OUT}$ to the antenna 18 based on the RF input signal $RF_{IN}$. A reflection of the RF output signal $RF_{OUT}$ is called the reflected RF signal $RF_{REFL}$ and may be fed into the RF output OUTPUT. The reflected RF signal $RF_{REFL}$ may be based on one or more impedance mismatch between the RF output OUTPUT and the antenna 18, an antenna impedance mismatch due to antenna characteristics, an antenna impedance mismatch due to antenna loading conditions, or any combination thereof. When processing RF signals in the forward direction 20, the electro-magnetic gyrator 12 provides processed RF signals from the second node SN based on the first node FN, and when processing RF signals in the reverse direction 22, the electro-magnetic gyrator 12 provides processed RF signals from the first node FN based on the second node SN.

When processing RF signals in the forward direction 20, the electro-magnetic gyrator 12 may operate as the bandpass filter, such that any RF signals falling within the passband of the bandpass filter may be forwarded from the first node FN to the second node SN with the insertion loss 30 (FIG. 3), which is dependent on the response characteristics of the bandpass filter. When processing RF signals in the reverse direction 22, the electro-magnetic gyrator 12 may operate as the single-notch filter having the notch frequency, such that any RF signals having the notch frequency or nearly the notch frequency may be attenuated and forwarded from second node SN to the first node FN with the return loss 32 (FIG. 3), which is dependent on the response characteristics of the single-notch filter. The first and the third capacitive elements C1, C3 may AC couple the output of the amplifier 16 to the RF input INPUT and may AC couple the RF output OUTPUT to the antenna 18, respectively. The response characteristics of the bandpass filter, the response characteristics of the single-notch filter, or both, may be based on the first, the second, the third, the fourth capacitive elements C1, C2, C3, C4, an impedance presented to the third and fourth nodes TN, FON of the variable impedance circuit 36, or any combination thereof. The impedance presented to the third and fourth nodes TN, FON is variable, may be used to control the notch frequency, and is based on the impedance control signal IMP-CONT. In alternate embodiments of the present invention, the frequency-adjustable RF isolator circuit 34 may be used as a stand-alone RF isolator, as an RF isolator in any kind of RF circuit, or both.

Figure 5A:
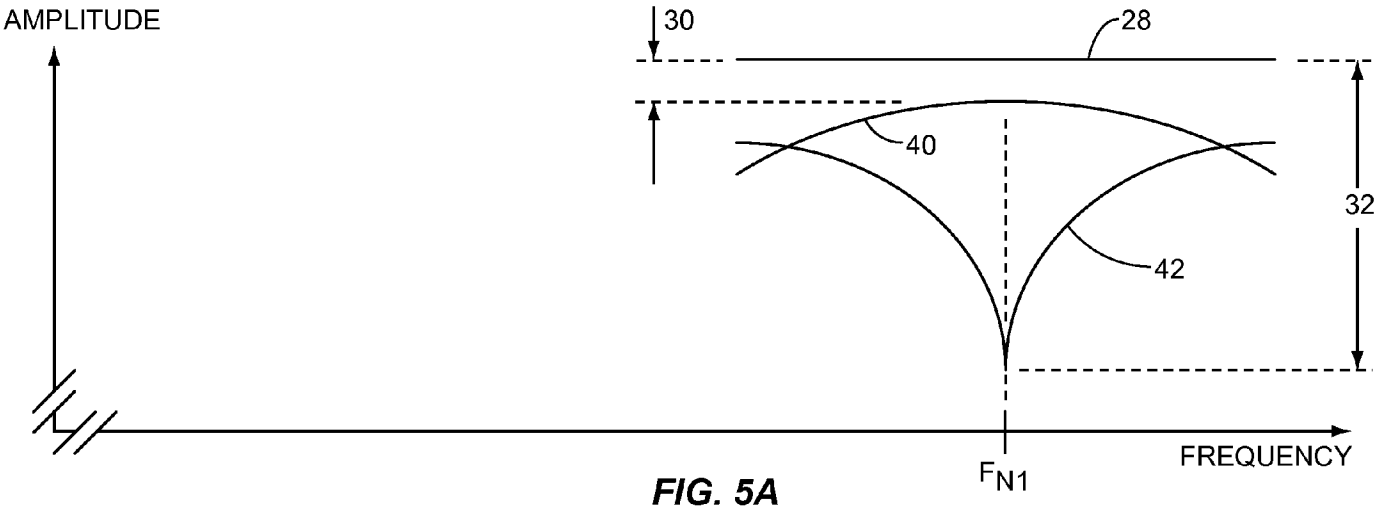
FIG. 5A is a graph showing a first forward direction frequency response and a first reverse direction frequency response of the frequency-adjustable RF isolator circuit illustrated in FIG. 4.

FIG. 5A is a graph showing a first forward direction frequency response 40 and a first reverse direction frequency response 42 of the frequency-adjustable RF isolator circuit 34 illustrated in FIG. 4. The zero db reference line 28 is shown for clarity. During a first operating mode, the frequency-adjustable RF isolator circuit 34 may have the first forward direction frequency response 40, which may approximate a bandpass filter response, and may have the insertion loss 30 at a first notch frequency $F_{N1}$. The first notch frequency $F_{N1}$ may be associated with a first impedance presented by the variable impedance circuit 36 to the electro-magnetic gyrator 12. The first impedance may have a first resistance and a first capacitive reactance. The insertion loss 30 is the difference between the zero db reference line 28, which is indicative of a magnitude of the RF input signal $RF_{IN}$, and the first forward direction frequency response 40, which is indicative of a magnitude of the RF output signal $RF_{OUT}$, at the first notch frequency $F_{N1}$. The first reverse direction frequency response 42 may approximate a single-notch filter response, and may have the return loss 32 at the first notch frequency $F_{N1}$. The return loss 32 is the difference between the zero db reference line 28, which is indicative of the magnitude of the reflected RF signal $RF_{REFL}$, and the first reverse direction frequency response 42, which is indicative of a magnitude of a processed reflected RF signal (not shown), at the first notch frequency $F_{N1}$. The insertion loss 30 and the return loss 32 may be useful in evaluating the effectiveness of the frequency-adjustable RF isolator circuit 34. Generally, a low insertion loss 30 may be desirable since the insertion loss 30 is indicative of how much of an RF transmit signal is lost in the frequency-adjustable RF isolator circuit 34. A high return loss 32 may be desirable since the return loss 32 is indicative of effectiveness at blocking reflected RF signals.

Figure 5B:
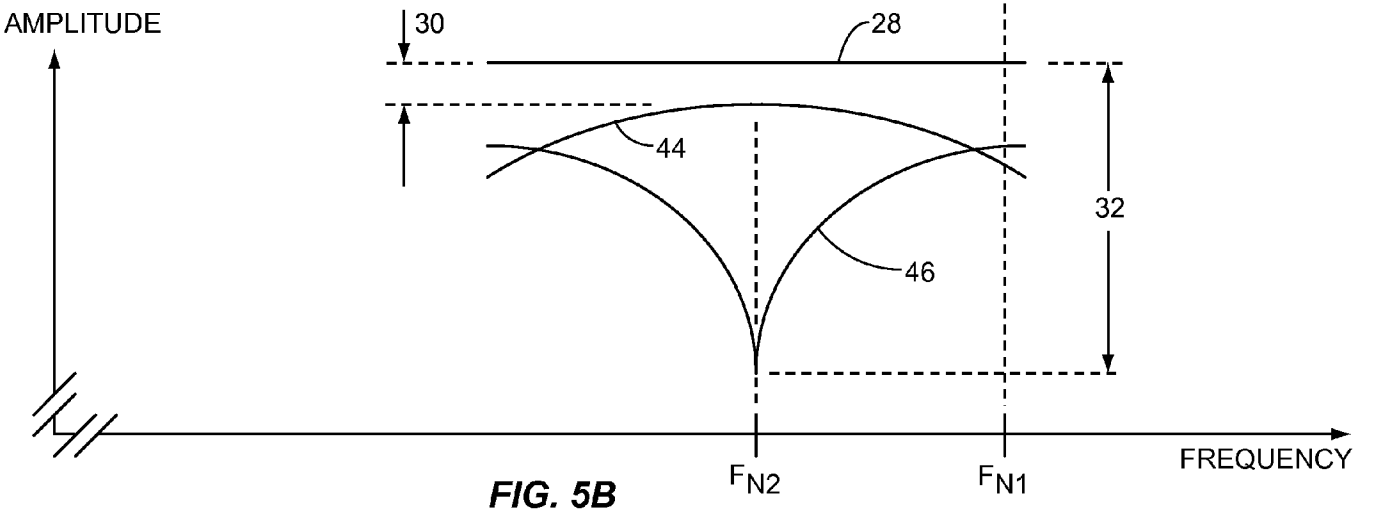
FIG. 5B is a graph showing a second forward direction frequency response and a second reverse direction frequency response of the frequency-adjustable RF isolator circuit illustrated in FIG. 4.

FIG. 5B is a graph showing a second forward direction frequency response 44 and a second reverse direction frequency response 46 of the frequency-adjustable RF isolator circuit 34 illustrated in FIG. 4. The zero db reference line 28 is shown for clarity. During a second operating mode, the frequency-adjustable RF isolator circuit 34 may have the second forward direction frequency response 44, which may approximate a bandpass filter response and may have the insertion loss 30 at a second notch frequency $F_{N2}$, which is different from the first notch frequency $F_{N1}$. The second notch frequency $F_{N2}$ may be associated with a second impedance presented by the variable impedance circuit 36 to the electro-magnetic gyrator 12. The second impedance may have a second resistance and a second capacitive reactance. The insertion loss 30 is the difference between the zero db reference line 28 and the second forward direction frequency response 44, which is indicative of a magnitude of the RF output signal $RF_{OUT}$ at the second notch frequency $F_{N2}$. The second reverse direction frequency response 46 may approximate a single-notch filter response and may have the return loss 32 at the second notch frequency $F_{N2}$. The return loss 32 is the difference between the zero db reference line 28 and the second reverse direction frequency response 46, which is indicative of a magnitude of a processed reflected RF signal (not shown), at the second notch frequency $F_{N2}$.

The control circuitry 38 may select either the first operating mode or the second operating mode, depending on a transmit frequency. In one embodiment of the present invention, the first notch frequency $F_{N1}$ may be about equal to a first transmit frequency, and the second notch frequency $F_{N2}$ may be about equal to a second transmit frequency. The first and second transmit frequencies may be within a single RF communications band or in separate RF communications bands. The first transmit frequency may be associated with an RF transmit channel, and the second transmit frequency may be associated with another RF transmit channel. In another embodiment of the present invention, the first notch frequency $F_{N1}$ may fall within a first RF communications band, and may be about equal to a center of the first RF communications band. The second notch frequency $F_{N2}$ may fall within a second RF communications band, and may be about equal to a center of the second RF communications band. In other embodiments of the present invention, the frequency-adjustable RF isolator circuit 34 may be associated with any number of operating modes having any number of notch frequencies.

In a first exemplary embodiment of the present invention, the return loss 32 is greater than the insertion loss 30. In a second exemplary embodiment of the present invention, the return loss 32 is at least three db greater than the insertion loss 30. In a third exemplary embodiment of the present invention, the return loss 32 is at least ten db greater than the insertion loss 30. In a fourth exemplary embodiment of the present invention, the return loss 32 is at least 20 db greater than the insertion loss 30. In a fifth exemplary embodiment of the present invention, the return loss 32 is at least 30 db greater than the insertion loss 30. In a sixth exemplary embodiment of the present invention, the return loss 32 is at least 40 db greater than the insertion loss 30. In a seventh exemplary embodiment of the present invention, the return loss 32 is at least 50 db greater than the insertion loss 30. In an eighth exemplary embodiment of the present invention, the return loss 32 is at least 60 db greater than the insertion loss 30. In a ninth exemplary embodiment of the present invention, the return loss 32 is at least 70 db greater than the insertion loss 30. In a tenth exemplary embodiment of the present invention, the return loss 32 is at least 80 db greater than the insertion loss 30.

Figure 6A:
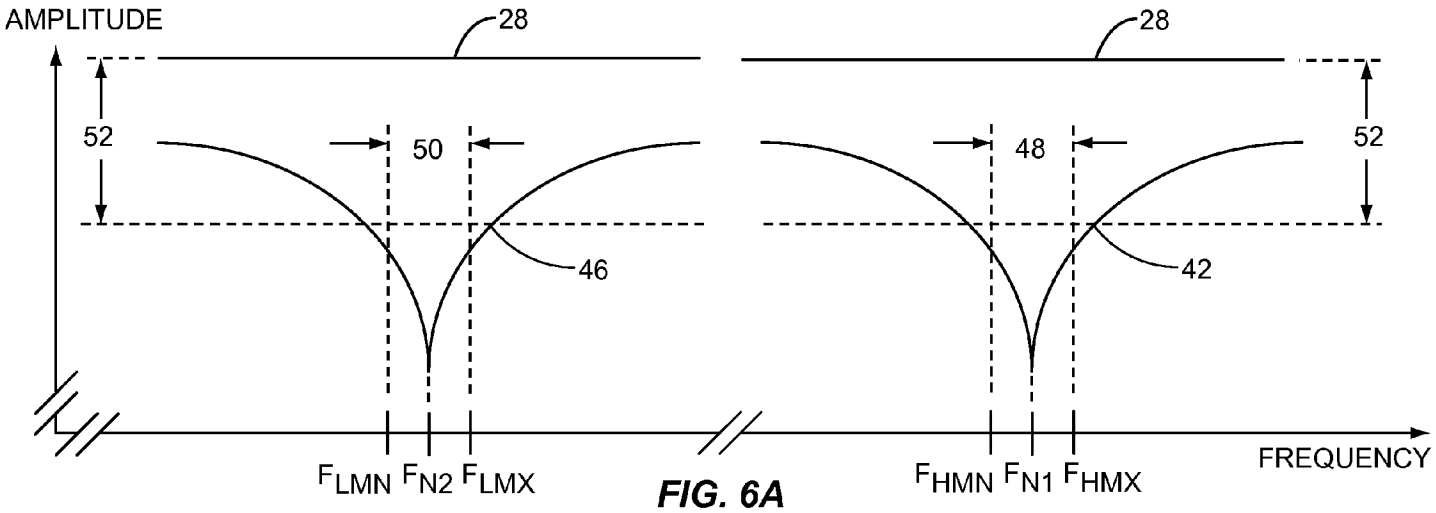
FIG. 6A is a graph showing a first notch frequency within a first RF communications band and a second notch frequency within a second RF communications band, according to an alternate embodiment of the present invention.

FIG. 6A is a graph showing the first notch frequency $F_{N1}$ within a first RF communications band 48 and the second notch frequency $F_{N2}$ within a second RF communications band 50, according to an alternate embodiment of the present invention. The first RF communications band 48 is a high-band RF communications band having a maximum highband frequency $F_{HMX}$ and a minimum highband frequency $F_{HMN}$. The first notch frequency $F_{N1}$ is between the maximum highband frequency $F_{HMX}$ and the minimum highband frequency $F_{HMN}$. A minimum acceptable return loss 52 is specified for all frequencies within the first RF communications band 48. Therefore, the first reverse direction frequency response 42 must fall below this limit for all frequencies within the first RF communications band 48.

The second RF communications band 50 is a lowband RF communications band having a maximum lowband frequency $F_{LMX}$ and a minimum lowband frequency $F_{LMN}$. The second notch frequency $F_{N2}$ is between the maximum lowband frequency $F_{LMX}$ and the minimum lowband frequency $F_{LMN}$. The minimum acceptable return loss 52 specifies the minimum acceptable return loss for all frequencies within the second RF communications band 50. Therefore, the second reverse direction frequency response 46 must fall below this limit for all frequencies within the second RF communications band 50.

Figure 6B:
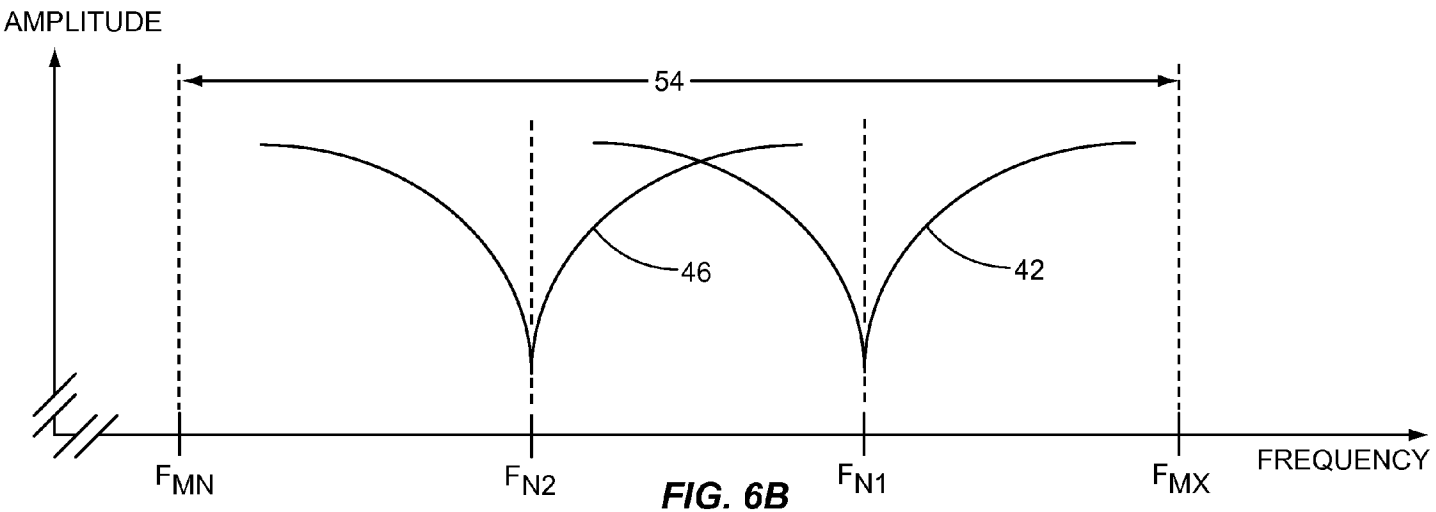
FIG. 6B is a graph showing the first notch frequency and the second notch frequency within a single RF communications band, according to an additional embodiment of the present invention.

FIG. 6B is a graph showing the first notch frequency $F_{N1}$ and the second notch frequency $F_{N2}$ within a single RF communications band 54, according to an additional embodiment of the present invention. The single RF communications band 54 has a maximum frequency $F_{MX}$ and a minimum frequency $F_{MN}$. In a first exemplary embodiment of the present invention, the first and second RF communications bands 48, 50 do not overlap. In a second exemplary embodiment of the present invention, the first and second RF communications bands 48, 50 overlap.

Figure 7:
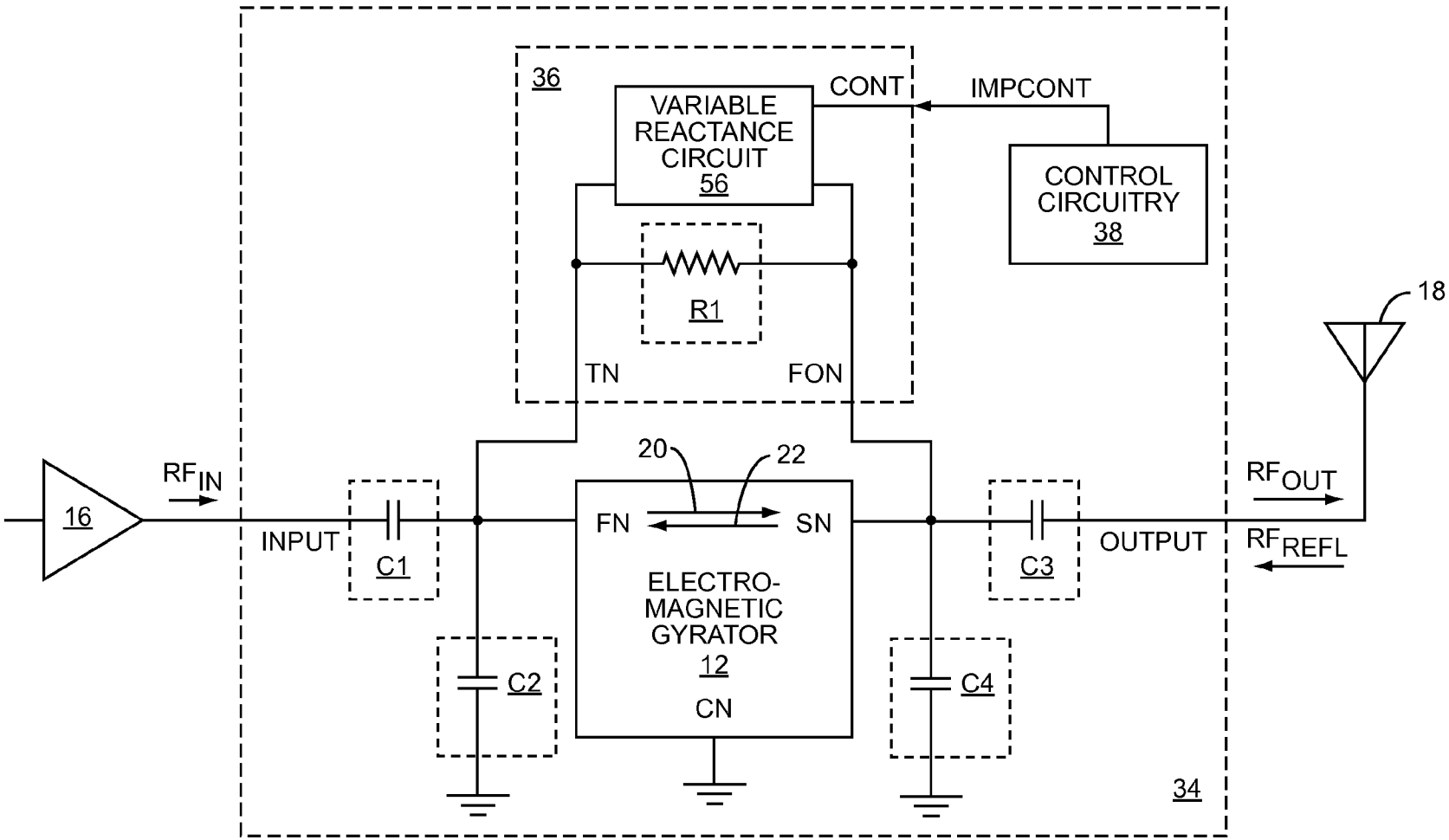
FIG. 7 shows details of a variable impedance circuit illustrated in FIG. 4, according to a first embodiment of the variable impedance circuit.

FIG. 7 shows details of the variable impedance circuit 36 illustrated in FIG. 4, according to a first embodiment of the variable impedance circuit 36. The variable impedance circuit 36 includes the first resistive element R1 coupled between the third node TN and the fourth node FON, and a variable reactance circuit 56 coupled between the third node TN and the fourth node FON. A notch frequency of the notch filter may be based on the first, the second, the third, the fourth capacitive elements C1, C2, C3, C4, a reactance presented between the third node TN and the fourth node FON by the variable reactance circuit 56, or any combination thereof. When processing RF signals in the forward direction 20, the electro-magnetic gyrator 12 may apply about zero phase-shift to the processed RF signals. When processing RF signals in the reverse direction 22, the electro-magnetic gyrator 12 may apply a phase-shift to the processed RF signals. At the notch frequency, the applied phase-shift may be equal to about 180 degrees, such that the processed RF signals in the reverse direction 22 may appear across the first resistive element R1 and be dissipated. At frequencies other than the notch frequency, the applied phase-shift may be less than 180 degrees, such that the processed RF signals in the reverse direction 22 may not be reduced as effectively as processed RF signals at the notch frequency.

Figure 8A:
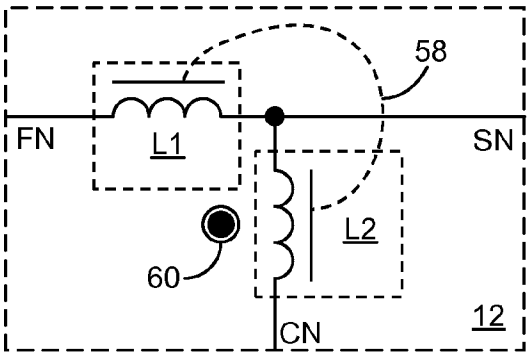
FIG. 8A shows details of an electro-magnetic gyrator illustrated in FIG. 4, according to one embodiment of the electro-magnetic gyrator.

FIG. 8A shows details of the electro-magnetic gyrator 12 illustrated in FIG. 4, according to one embodiment of the electro-magnetic gyrator 12. The electro-magnetic gyrator 12 includes a first inductive element L1 coupled between the first node FN and the second node SN, and a second inductive element L2 coupled between the second node SN and the common node CN. The first and second inductive elements L1, L2 may share a common RF core 58, which may have a static magnetic field 60. Interactions between the first and second inductive elements L1, L2, the common RF core 58, and the static magnetic field 60 provide non-reciprocal characteristics of the electro-magnetic gyrator 12. In a first embodiment of the electro-magnetic gyrator 12, the common RF core 58 is permanently magnetized, which provides the static magnetic field 60. In a second embodiment of the electro-magnetic gyrator 12, the electro-magnetic gyrator 12 includes an external permanent magnet (not shown), which provides the static magnetic field 60. In a third embodiment of the electro-magnetic gyrator 12, the electro-magnetic gyrator 12 includes an electro-magnet magnet, which during the first and second operating modes is energized and provides the static magnetic field 60. In one embodiment of the electro-magnetic gyrator 12, the common RF core 58 may include ferrite.

Figure 8B:
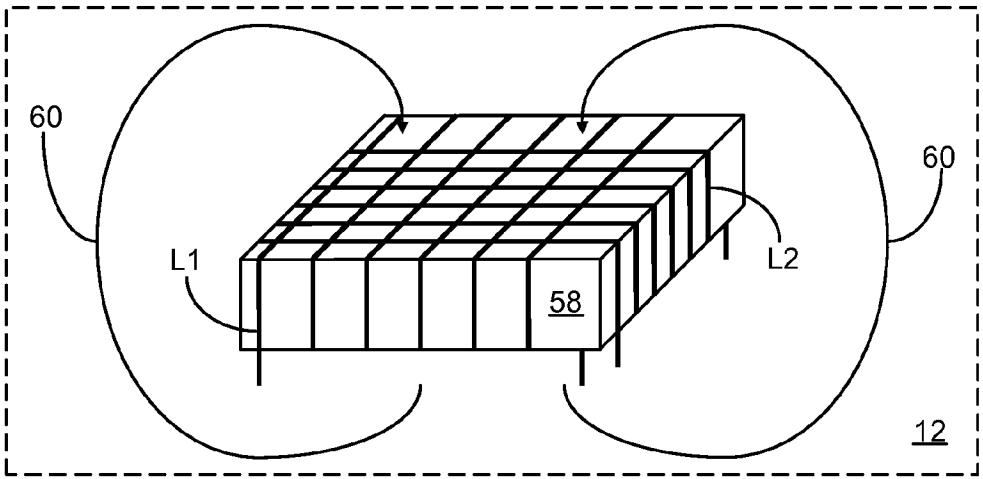
FIG. 8B shows construction details of the electro-magnetic gyrator illustrated in FIG. 8A.

FIG. 8B shows construction details of the electro-magnetic gyrator 12 illustrated in FIG. 8A. The first inductive element L1 substantially encircles a first region of the common RF core 58, and the second inductive element L2 substantially encircles a second region of the common RF core 58. A winding direction of the first inductive element L1 is translated about 90 degrees from a winding direction of the second inductive element L2. The static magnetic field 60 penetrates both the first and the second inductive elements L1, L2 and the common RF core 58.

Figure 9:
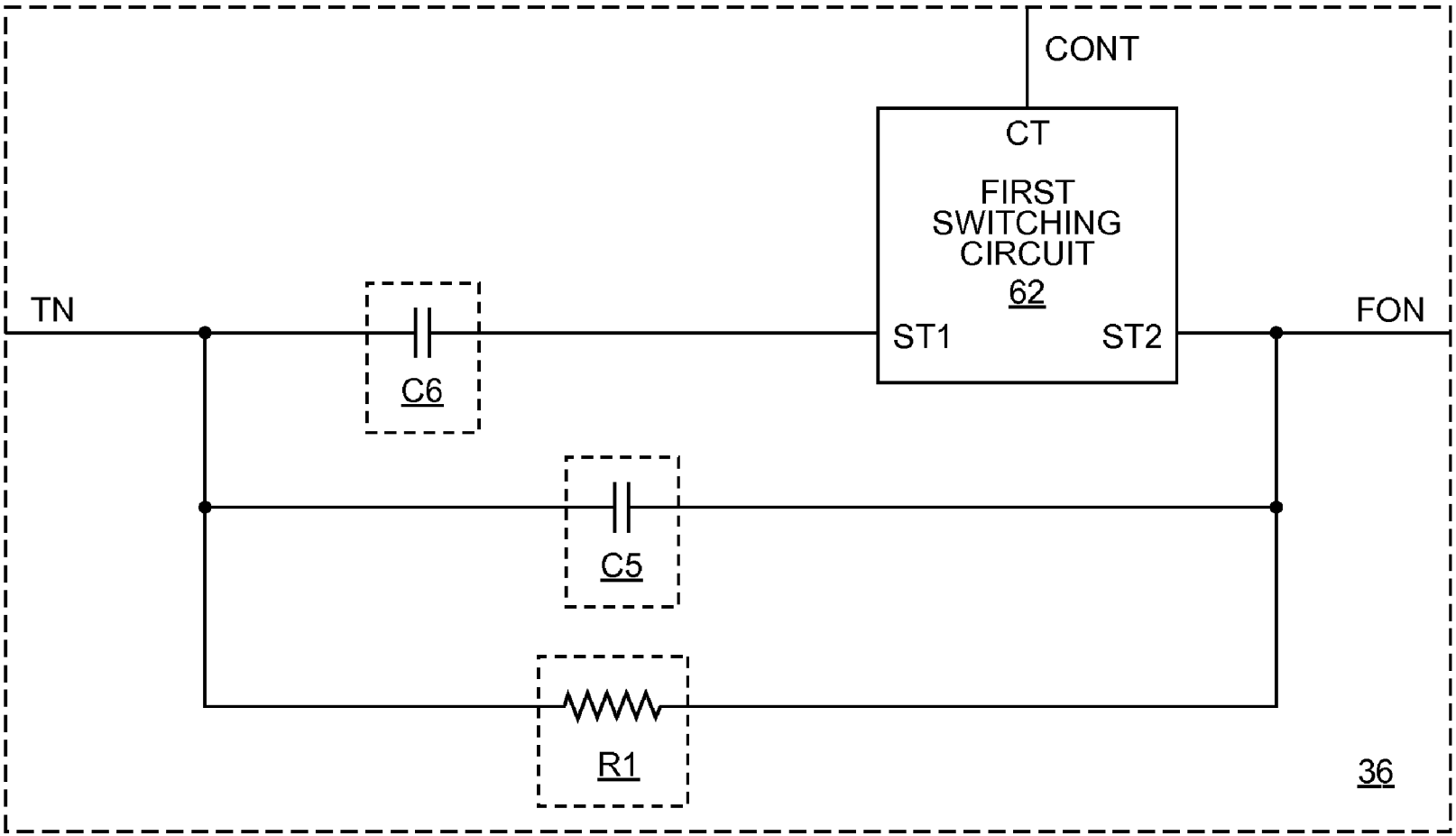
FIG. 9 shows details of the variable impedance circuit illustrated in FIG. 4, according to a second embodiment of the variable impedance circuit.

FIG. 9 shows details of the variable impedance circuit 36 illustrated in FIG. 4, according to a second embodiment of the variable impedance circuit 36. The variable impedance circuit 36 includes a first switching circuit 62 having a first switching terminal ST1, a second switching terminal ST2, and a control terminal CT, and a sixth capacitive element C6. During the first operating mode, the first switching circuit 62 has an OPEN state, such that an open switch impedance, or very high impedance, is presented between the first and second switching terminals ST1, ST2. During the second operating mode, the first switching circuit 62 has a CLOSED state, such that a closed switch impedance, or very low impedance, is presented between the first and second switching terminals ST1, ST2. Selection of the OPEN state or the CLOSED state is based on a control signal received at the control terminal CT.

The first resistive element R1 is coupled between the third node TN and the fourth node FON. The fifth capacitive element C5 is coupled between the third node TN and the fourth node FON. The sixth capacitive element C6 is coupled between the third node TN and the first switching terminal ST1. The second switching terminal ST2 is coupled to the fourth node FON. The control terminal CT is coupled to the control node CONT. During the OPEN state, the parallel combination of the first resistive element R1 and the fifth capacitive element C5 provides the impedance between the third node TN and the fourth node FON. During the CLOSED state, the parallel combination of the first resistive element R1, the fifth capacitive element C5, and the sixth capacitive element C6 provides the impedance between the third node TN and the fourth node FON.

Figure 10:
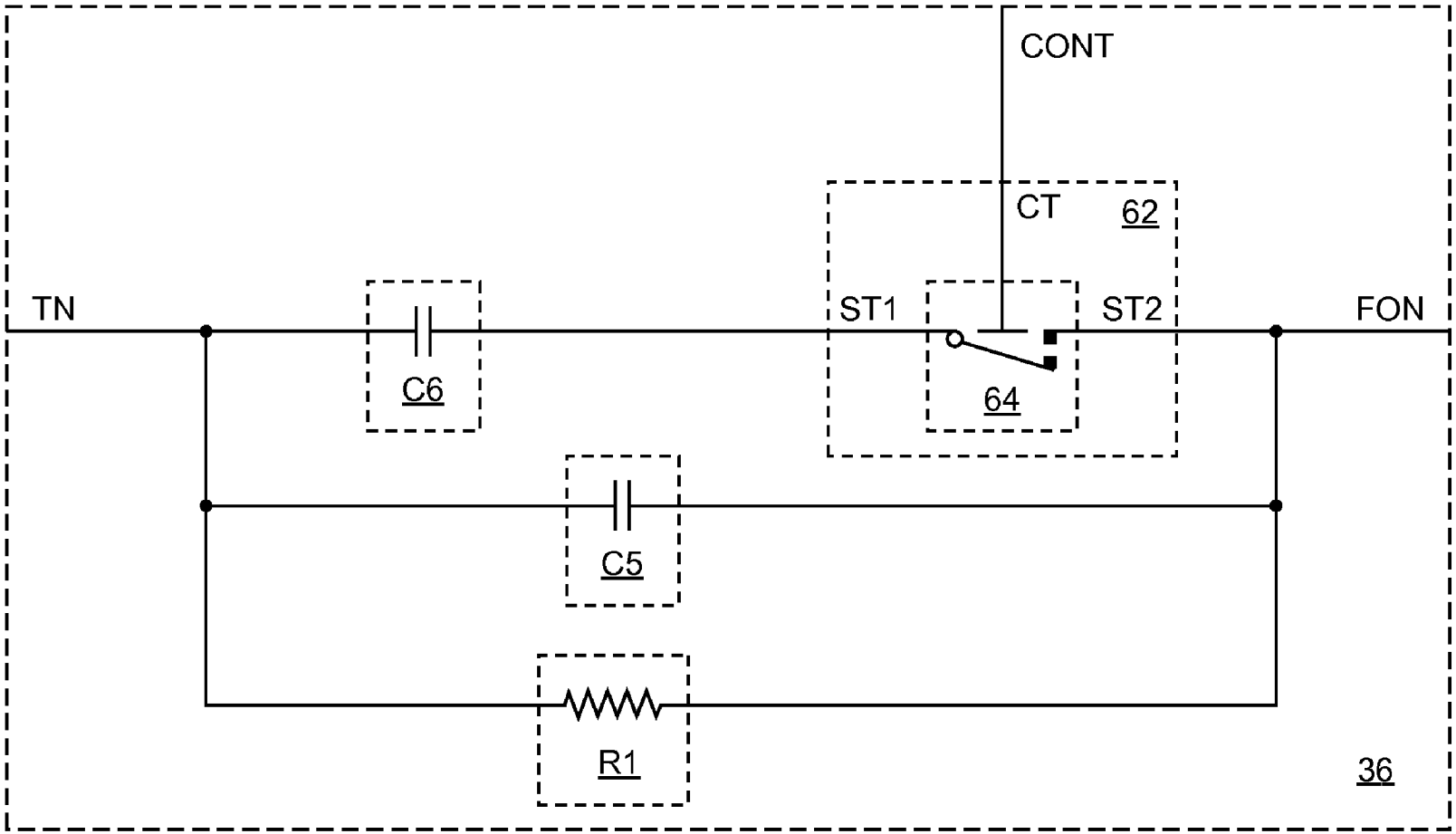
FIG. 10 shows details of the variable impedance circuit illustrated in FIG. 4, according to a third embodiment of the variable impedance circuit.

FIG. 10 shows details of the variable impedance circuit 36 illustrated in FIG. 9, according to a third embodiment of the variable impedance circuit 36. The first switching circuit 62 includes a MEMS switch 64 having a first contact coupled to the first switching terminal ST1, a second contact coupled to the second switching terminal ST2, and an actuator coupled to the control terminal CT. During the first operating mode, the MEMS switch 64 has the OPEN state, such that the first and second contacts do not electrically connect one to the other. During the second operating mode, the MEMS switch 64 has the CLOSED state, such that the actuator brings the first and second contacts together, such that the first and second contacts electrically connect one to the other. Selection of the OPEN state or the CLOSED state is based on the control signal received at the control terminal CT.

Figure 11:
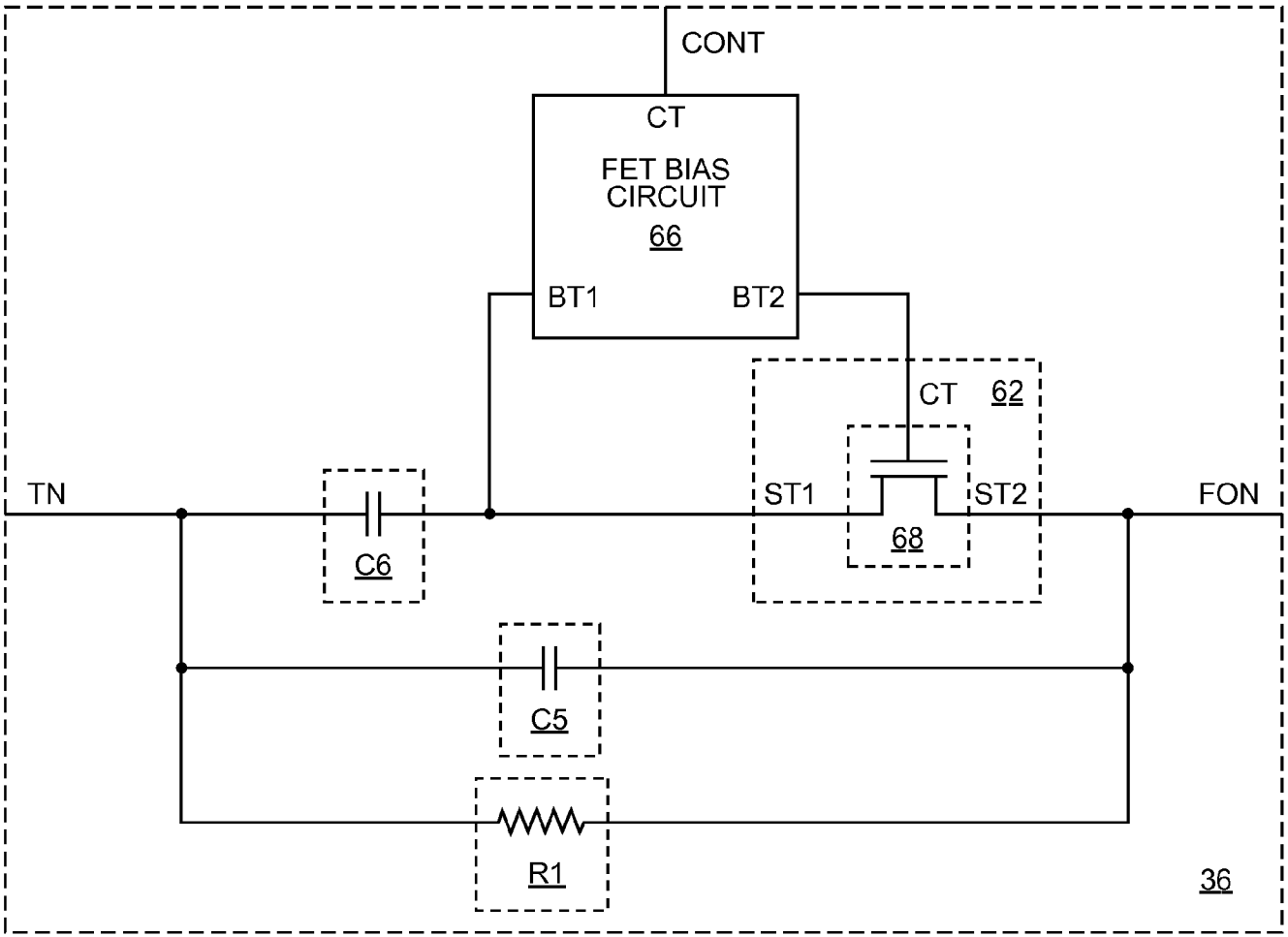
FIG. 11 shows details of the variable impedance circuit illustrated in FIG. 4, according to a fourth embodiment of the variable impedance circuit.

FIG. 11 shows details of the variable impedance circuit 36 illustrated in FIG. 4, according to a fourth embodiment of the variable impedance circuit 36. The variable impedance circuit 36 illustrated in FIG. 11 is similar to the variable impedance circuit 36 illustrated in FIG. 9, except the variable impedance circuit 36 illustrated in FIG. 11 includes an FET bias circuit 66 having a first bias terminal BT1, a second bias terminal BT2, and a control terminal CT, which is coupled to the control node CONT. The first switching circuit 62 includes an FET element 68 having a source coupled to the first switching terminal ST1, a drain coupled to the second switching terminal ST2, and a gate coupled to the control terminal CT of the first switching circuit 62. The first bias terminal BT1 is coupled to the first switching terminal ST1. The second bias terminal BT2 is coupled to the control terminal CT of the first switching circuit 62. During the first operating mode, the FET bias circuit 66 applies a bias voltage between the gate and the source, such that the FET element 68 has the OPEN state, wherein the FET element 68 presents substantially an open circuit between the drain and the source. During the second operating mode, the FET bias circuit 66 applies a bias voltage between the gate and the source, such that the FET element 68 has the CLOSED state, wherein the FET element 68 presents an ON impedance between the drain and the source. Selection of the OPEN state or the CLOSED state is based on the control signal received at the control terminal CT of the FET bias circuit 66.

The FET element 68 may include an N-type FET (N-FET), a P-type FET (P-FET), a metal oxide semiconductor (MOS) FET (MOSFET), an N-type MOSFET (N-MOSFET), a P-type MOSFET (P-MOSFET), or any combination thereof. In alternate embodiments of the variable impedance circuit 36, the source may be coupled to the second switching terminal ST2, the drain may be coupled to the first switching terminal ST1, and the first bias terminal BT1 may be coupled to the second switching terminal ST2.

Figure 12:
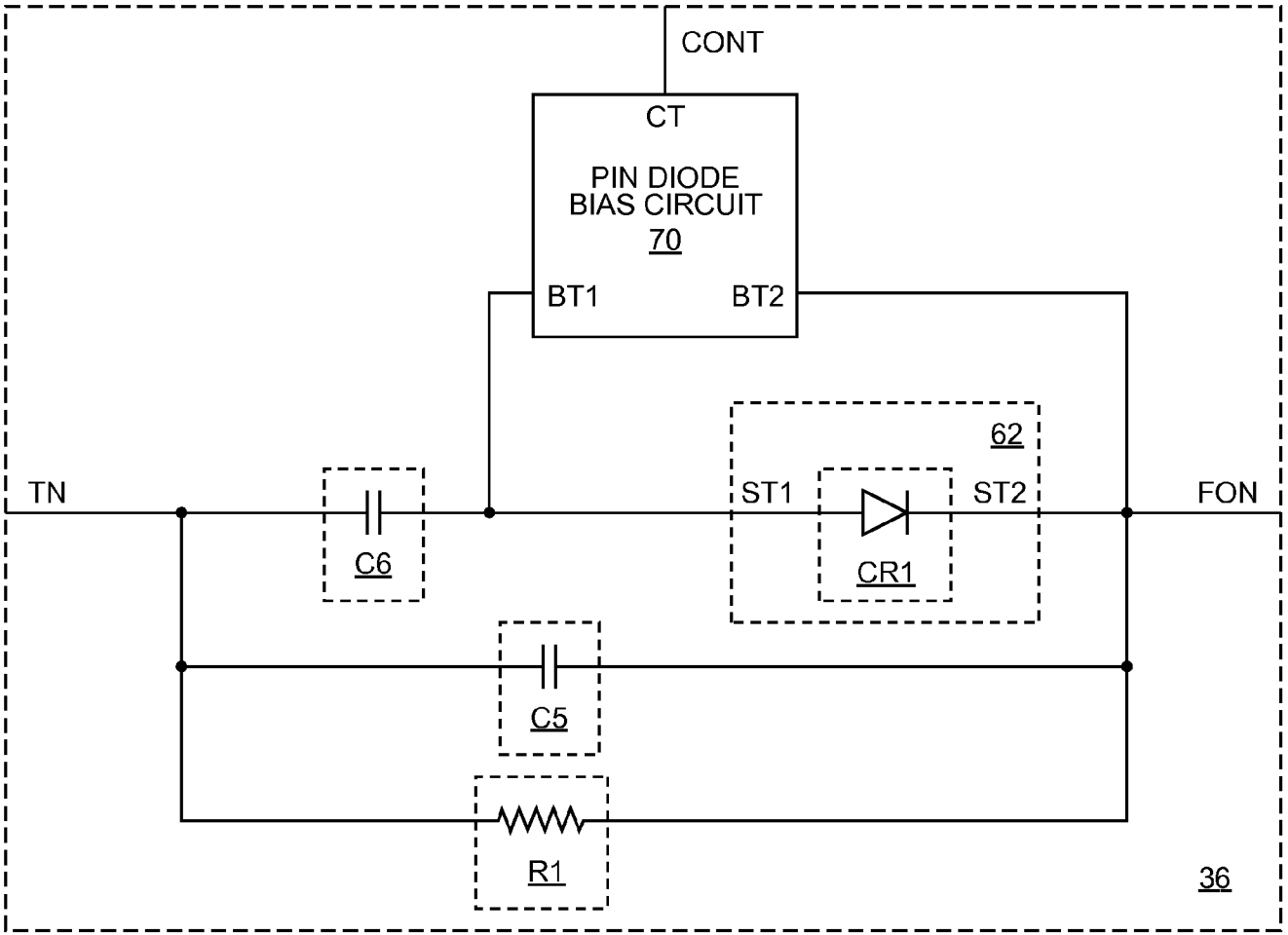
FIG. 12 shows details of the variable impedance circuit illustrated in FIG. 4, according to a fifth embodiment of the variable impedance circuit.

FIG. 12 shows details of the variable impedance circuit 36 illustrated in FIG. 4, according to a fifth embodiment of the variable impedance circuit 36. The variable impedance circuit 36 illustrated in FIG. 12 is similar to the variable impedance circuit 36 illustrated in FIG. 9, except the variable impedance circuit 36 illustrated in FIG. 12 includes a PIN diode bias circuit 70 having a first bias terminal BT1, a second bias terminal BT2, and a control terminal CT, which is coupled to the control node CONT. The first switching circuit 62 includes a PIN diode element CR1 having an anode coupled to the first switching terminal ST1 and a cathode coupled to the second switching terminal ST2. The first bias terminal BT1 is coupled to the first switching terminal ST1. The second bias terminal BT2 is coupled to the second switching terminal ST2. During the first operating mode, the PIN diode bias circuit 70 applies a bias voltage between the anode and the cathode, such that the PIN diode element CR1 has the OPEN state, wherein the PIN diode element CR1 presents substantially an open circuit between the anode and the cathode. During the second operating mode, the PIN diode bias circuit 70 applies a bias voltage between the anode and the cathode, such that the PIN diode element CR1 has the CLOSED state, wherein the PIN diode element CR1 presents an ON impedance between the anode and the cathode. Selection of the OPEN state or the CLOSED state is based on the control signal received at the control terminal CT of the PIN diode bias circuit 70.

Figure 13:
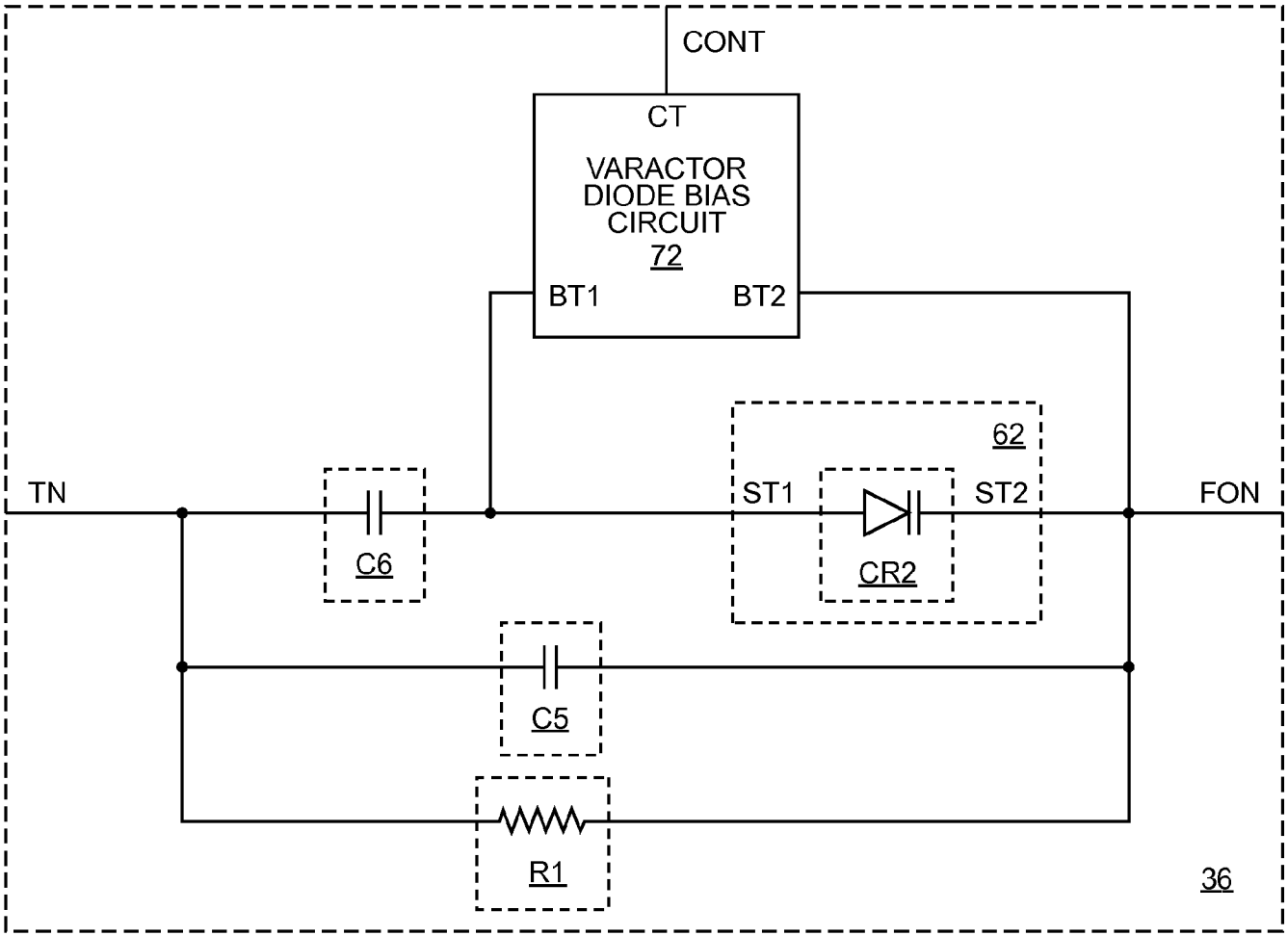
FIG. 13 shows details of the variable impedance circuit illustrated in FIG. 4, according to a sixth embodiment of the variable impedance circuit.

FIG. 13 shows details of the variable impedance circuit 36 illustrated in FIG. 4, according to a sixth embodiment of the variable impedance circuit 36. The variable impedance circuit 36 illustrated in FIG. 13 is similar to the variable impedance circuit 36 illustrated in FIG. 9, except the variable impedance circuit 36 illustrated in FIG. 13 includes a varactor diode bias circuit 72 having a first bias terminal BT1, a second bias terminal BT2, and a control terminal CT, which is coupled to the control node CONT. The first switching circuit 62 includes a varactor diode element CR2 having an anode coupled to the first switching terminal ST1 and a cathode coupled to the second switching terminal ST2. The first bias terminal BT1 is coupled to the first switching terminal ST1. The second bias terminal BT2 is coupled to the second switching terminal ST2. During the first operating mode, the varactor diode bias circuit 72 applies a first reverse bias voltage between the anode and the cathode, such that the varactor diode element CR2 presents a first capacitance between the anode and the cathode. During the second operating mode, the varactor diode bias circuit 72 applies a second reverse bias voltage between the anode and the cathode, such that the varactor diode element CR2 presents a second capacitance between the anode and the cathode. Selection of the first reverse bias voltage or the second reverse bias voltage is based on the control signal received at the control terminal CT of the varactor diode bias circuit 72.

During the first operating mode, the impedance between the third node TN and the fourth node FON is provided by the parallel combination of the first resistive element R1, the fifth capacitive element C5, and the series combination of the sixth capacitive element C6 and the first capacitance. During the second operating mode, the impedance between the third node TN and the fourth node FON is provided by the parallel combination of the first resistive element R1, the fifth capacitive element C5, and the series combination of the sixth capacitive element C6 and the second capacitance. In alternate embodiments of the present invention, the variable impedance circuit 36 may have multiple operating modes associated with multiple values of reverse bias voltage and corresponding varactor diode capacitances. The varactor diode element CR2 may be continuously tuned instead of discretely tuned. Therefore, the notch frequency may be continuously tuned. In an exemplary embodiment of the present invention, the notch frequency is tuned to each transmit channel prior to transmitting.

Figure 14:
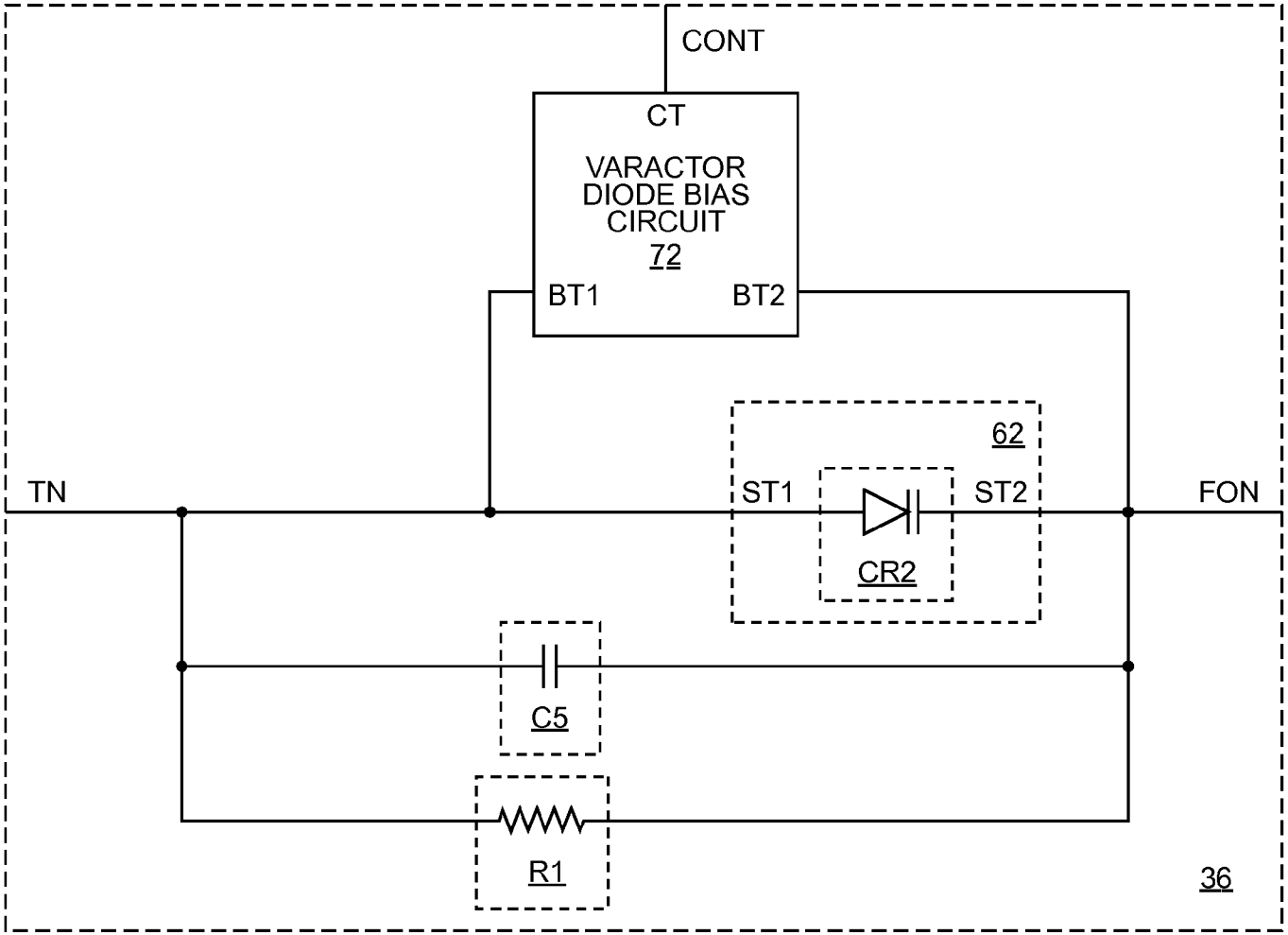
FIG. 14 shows details of the variable impedance circuit illustrated in FIG. 4, according to a seventh embodiment of the variable impedance circuit.

FIG. 14 shows details of the variable impedance circuit 36 illustrated in FIG. 4, according to a seventh embodiment of the variable impedance circuit 36. The variable impedance circuit 36 illustrated in FIG. 14 is similar to the variable impedance circuit 36 illustrated in FIG. 13, except the variable impedance circuit 36 illustrated in FIG. 14 does not include the sixth capacitive element C6. The first switching terminal ST1 and the first bias terminal BT1 are coupled to the third node TN instead of being coupled to the sixth capacitive element C6.

Figure 15:
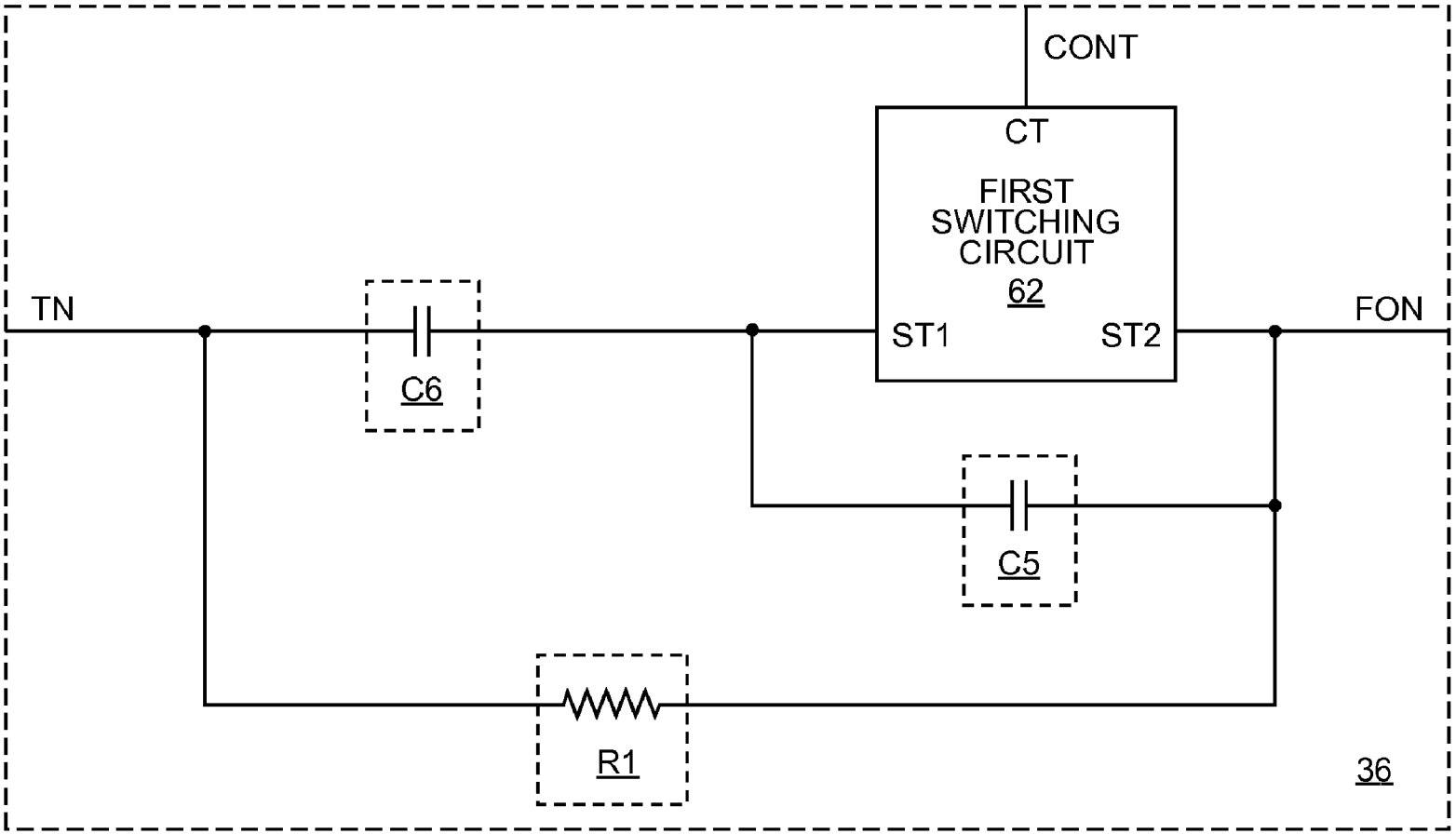
FIG. 15 shows details of the variable impedance circuit illustrated in FIG. 4, according to an eighth embodiment of the variable impedance circuit.

FIG. 15 shows details of the variable impedance circuit 36 illustrated in FIG. 4, according to an eighth embodiment of the variable impedance circuit 36. The variable impedance circuit 36 illustrated in FIG. 15 is similar to the variable impedance circuit 36 illustrated in FIG. 9, except in the variable impedance circuit 36 illustrated in FIG. 15, the fifth capacitive element C5 is coupled between the first switching terminal ST1 and the fourth node FON instead of being coupled between the third node TN and the fourth node FON. During the OPEN state, the parallel combination of the first resistive element R1 and the series combination of the fifth capacitive element C5 and the sixth capacitive element C6 provides the impedance between the third node TN and the fourth node FON. During the CLOSED state, the parallel combination of the first resistive element R1 and the fifth capacitive element C5 provides the impedance between the third node TN and the fourth node FON.

Figure 16:
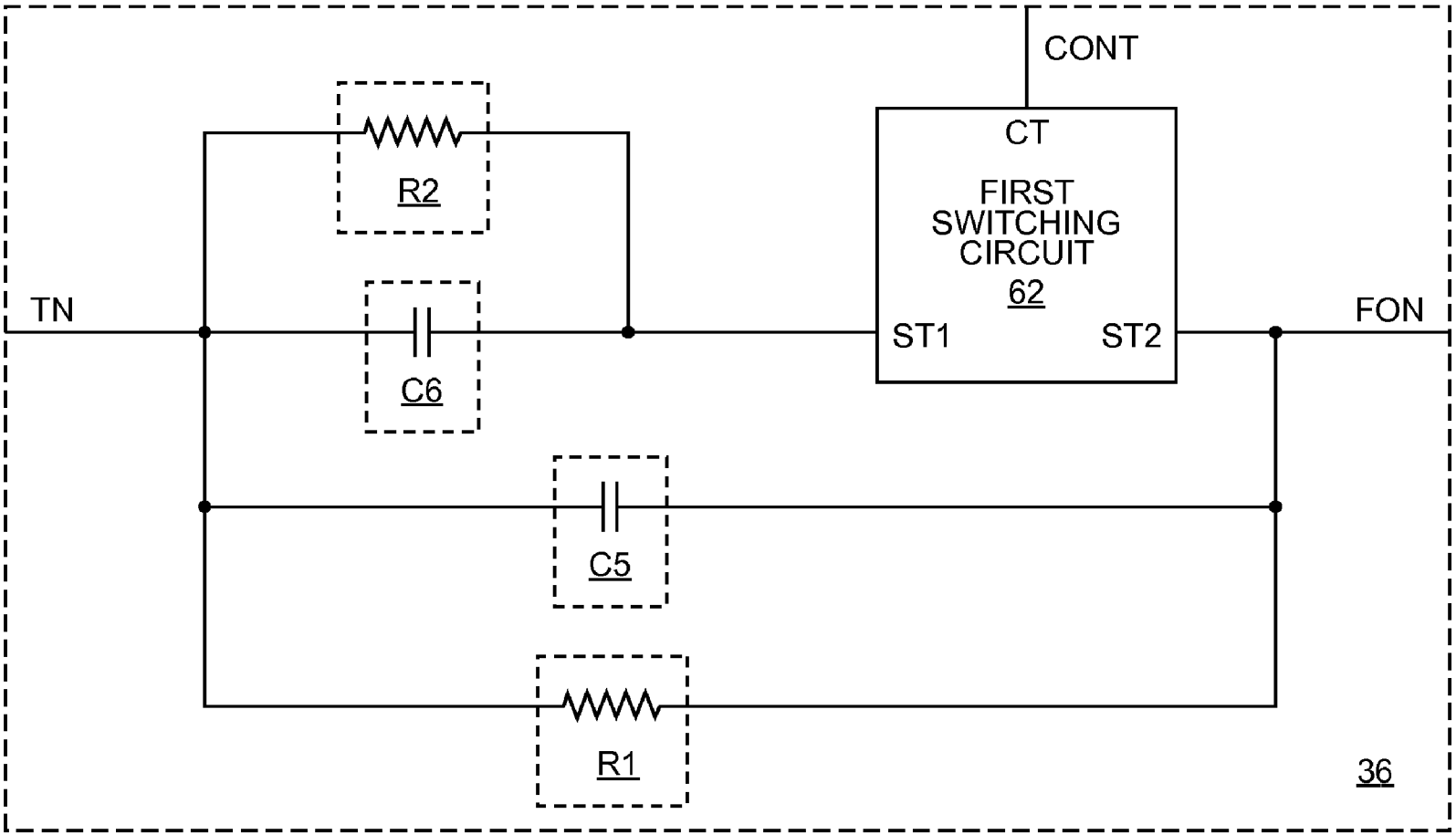
FIG. 16 shows details of the variable impedance circuit illustrated in FIG. 4, according to a ninth embodiment of the variable impedance circuit.

FIG. 16 shows details of the variable impedance circuit 36 illustrated in FIG. 4, according to a ninth embodiment of the variable impedance circuit 36. The variable impedance circuit 36 illustrated in FIG. 16 is similar to the variable impedance circuit 36 illustrated in FIG. 9, except the variable impedance circuit 36 illustrated in FIG. 16 includes a second resistive element R2 coupled in parallel with the sixth capacitive element C6. During the OPEN state, the parallel combination of the first resistive element R1 and the fifth capacitive element C5 provides the impedance between the third node TN and the fourth node FON. During the CLOSED state, the parallel combination of the first resistive element R1, the fifth capacitive element C5, the sixth capacitive element C6, and the second resistive element R2 provides the impedance between the third node TN and the fourth node FON. Changing the resistance presented to the third node TN and the fourth node FON may optimize the depth of the notch at the first and second notch frequencies $F_{N1}$, $F_{N2}$.

Figure 17:
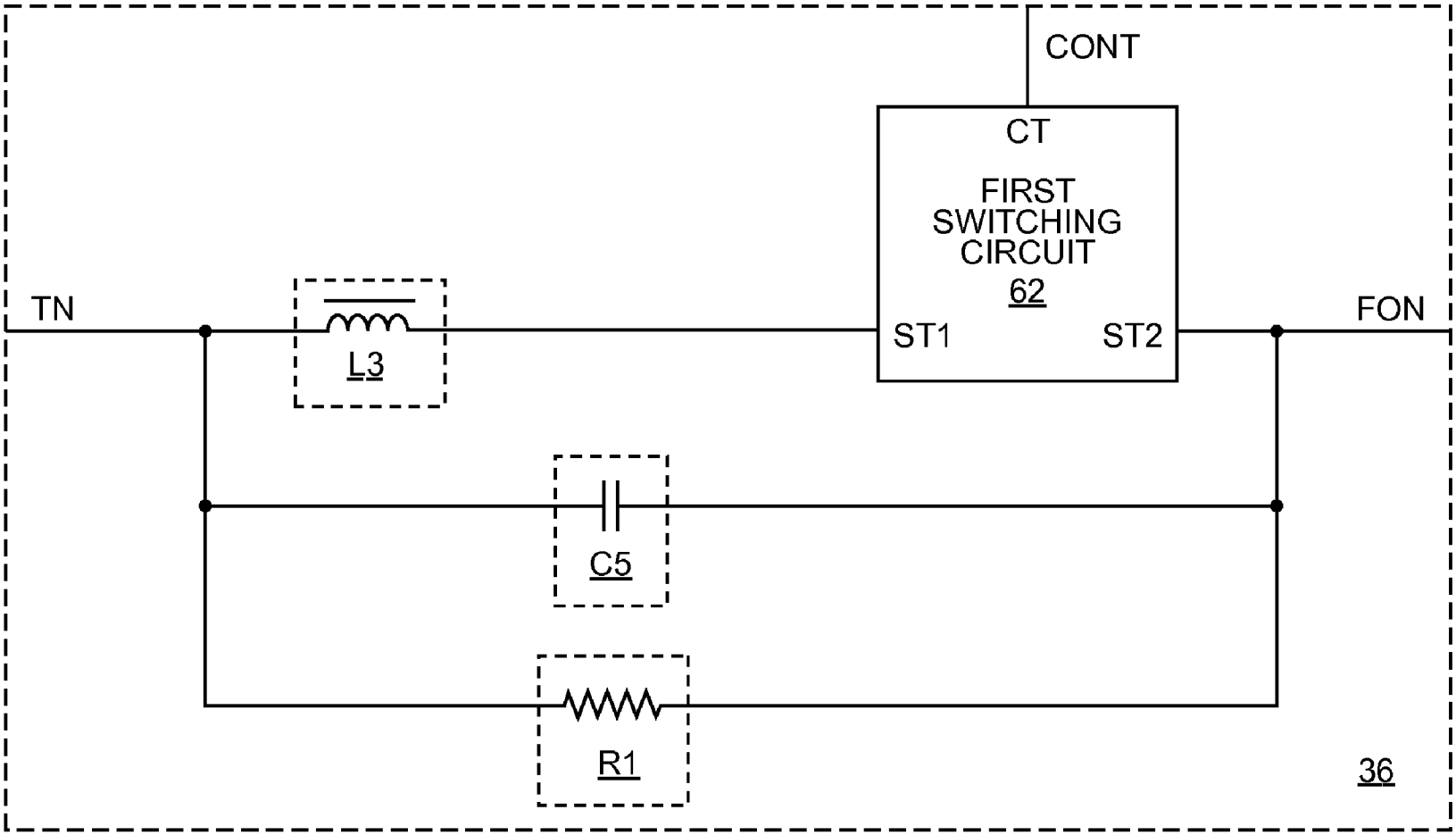
FIG. 17 shows details of the variable impedance circuit illustrated in FIG. 4, according to a tenth embodiment of the variable impedance circuit.

FIG. 17 shows details of the variable impedance circuit 36 illustrated in FIG. 4, according to a tenth embodiment of the variable impedance circuit 36. The variable impedance circuit 36 illustrated in FIG. 17 is similar to the variable impedance circuit 36 illustrated in FIG. 9, except the variable impedance circuit 36 illustrated in FIG. 17 includes a third inductive element L3 in place of the sixth capacitive element C6. During the OPEN state, the parallel combination of the first resistive element R1 and the fifth capacitive element C5 provides the impedance between the third node TN and the fourth node FON. During the CLOSED state, the parallel combination of the first resistive element R1, the fifth capacitive element C5, and the third inductive element L3 provides the impedance between the third node TN and the fourth node FON.

Figure 18:
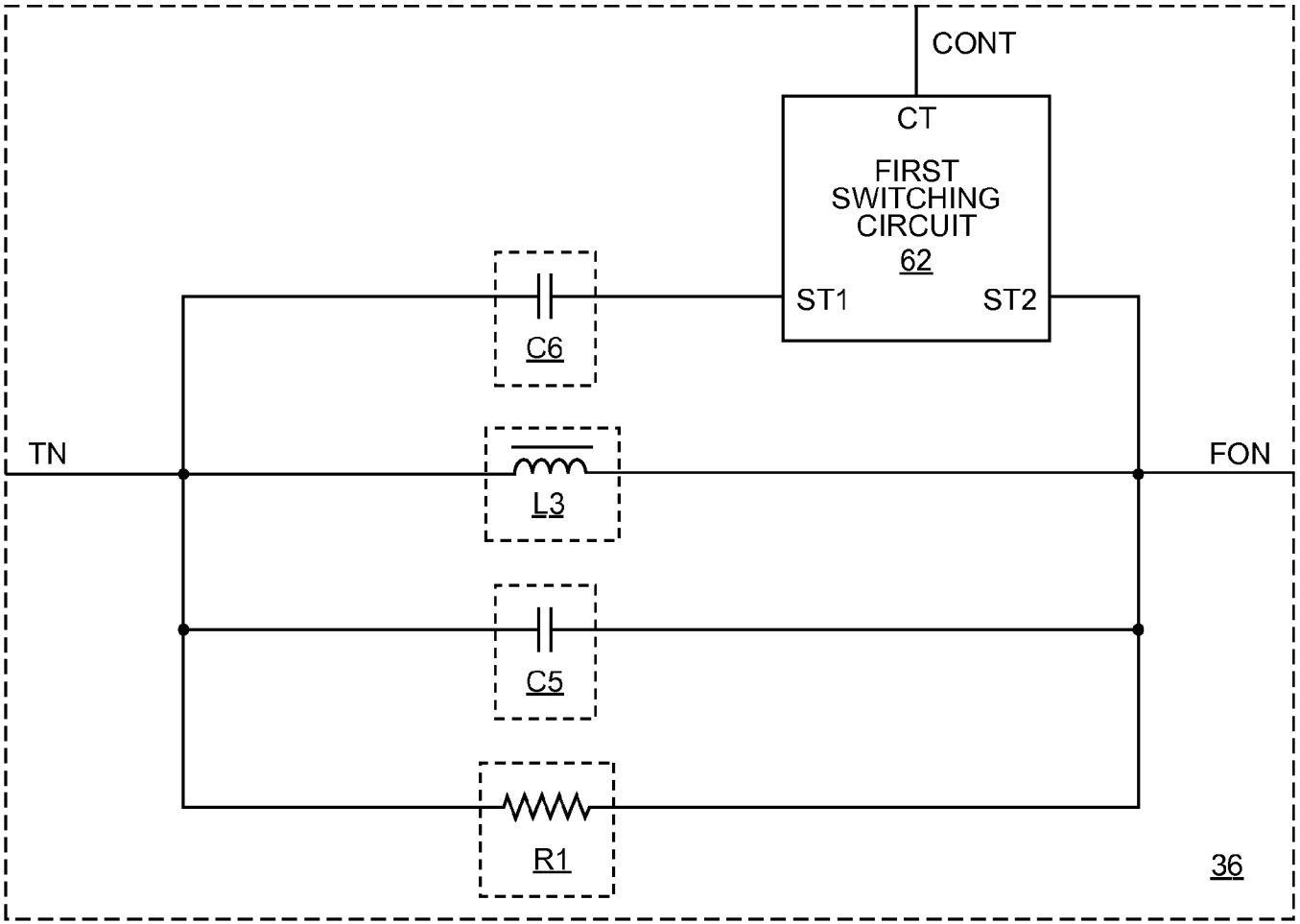
FIG. 18 shows details of the variable impedance circuit illustrated in FIG. 4, according to an eleventh embodiment of the variable impedance circuit.

FIG. 18 shows details of the variable impedance circuit 36 illustrated in FIG. 4, according to an eleventh embodiment of the variable impedance circuit 36. The variable impedance circuit 36 illustrated in FIG. 18 is similar to the variable impedance circuit 36 illustrated in FIG. 9, except the variable impedance circuit 36 illustrated in FIG. 18 includes the third inductive element L3 coupled between the third node TN and the fourth node FON. During the OPEN state, the parallel combination of the first resistive element R1, the fifth capacitive element C5, and the third inductive element L3 provides the impedance between the third node TN and the fourth node FON. During the CLOSED state, the parallel combination of the first resistive element R1, the fifth capacitive element C5, the third inductive element L3, and the sixth capacitive element C6 provides the impedance between the third node TN and the fourth node FON.

Figure 19:
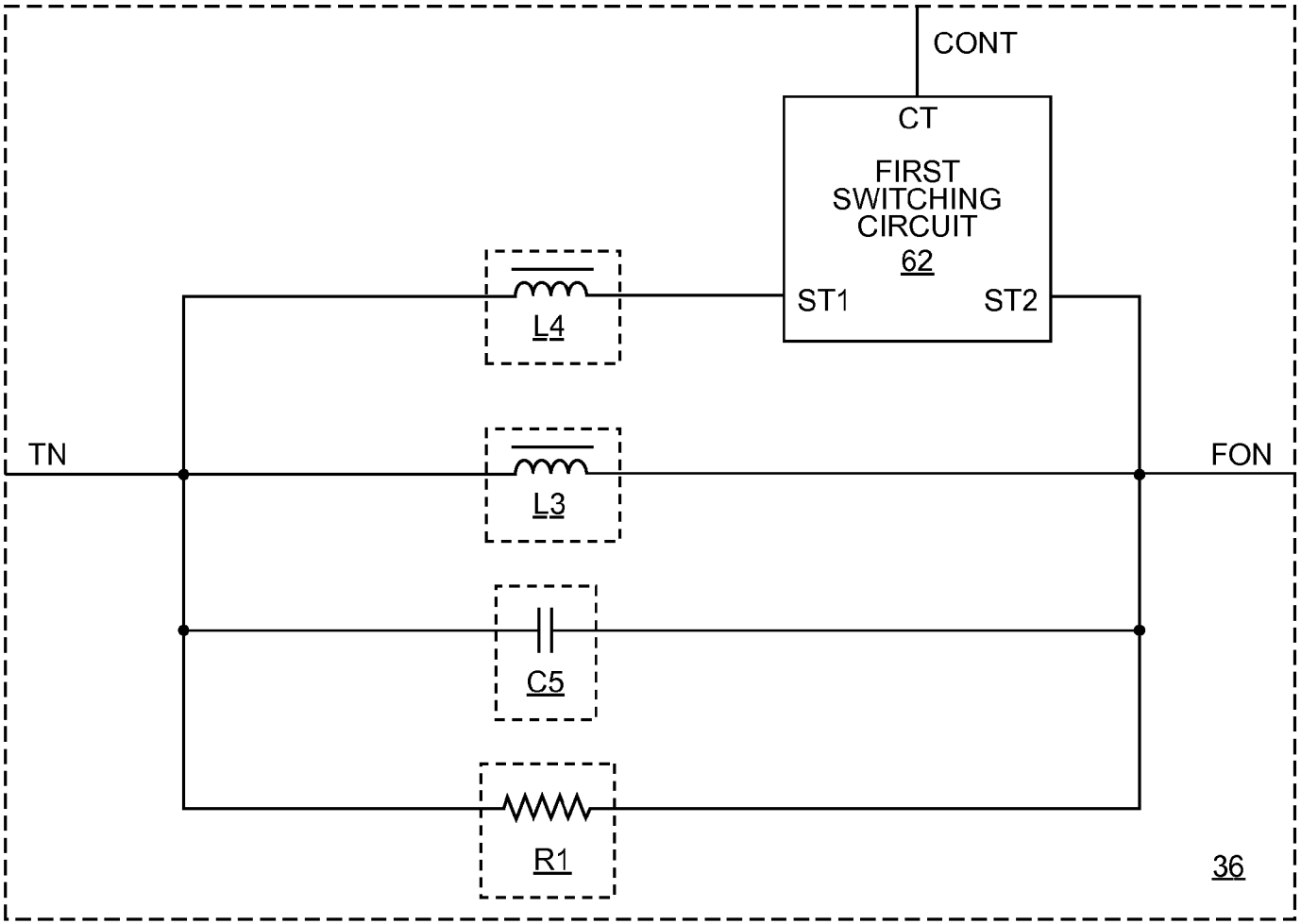
FIG. 19 shows details of the variable impedance circuit illustrated in FIG. 4, according to a twelfth embodiment of the variable impedance circuit.

FIG. 19 shows details of the variable impedance circuit 36 illustrated in FIG. 4, according to a twelfth embodiment of the variable impedance circuit 36. The variable impedance circuit 36 illustrated in FIG. 19 is similar to the variable impedance circuit 36 illustrated in FIG. 18, except the variable impedance circuit 36 illustrated in FIG. 19 includes a fourth inductive element L4 in place of the sixth capacitive element C6. During the OPEN state, the parallel combination of the first resistive element R1, the fifth capacitive element C5, and the third inductive element L3 provides the impedance between the third node TN and the fourth node FON. During the CLOSED state, the parallel combination of the first resistive element R1, the fifth capacitive element C5, the third inductive element L3, and the fourth inductive element L4 provides the impedance between the third node TN and the fourth node FON.

Figure 20:
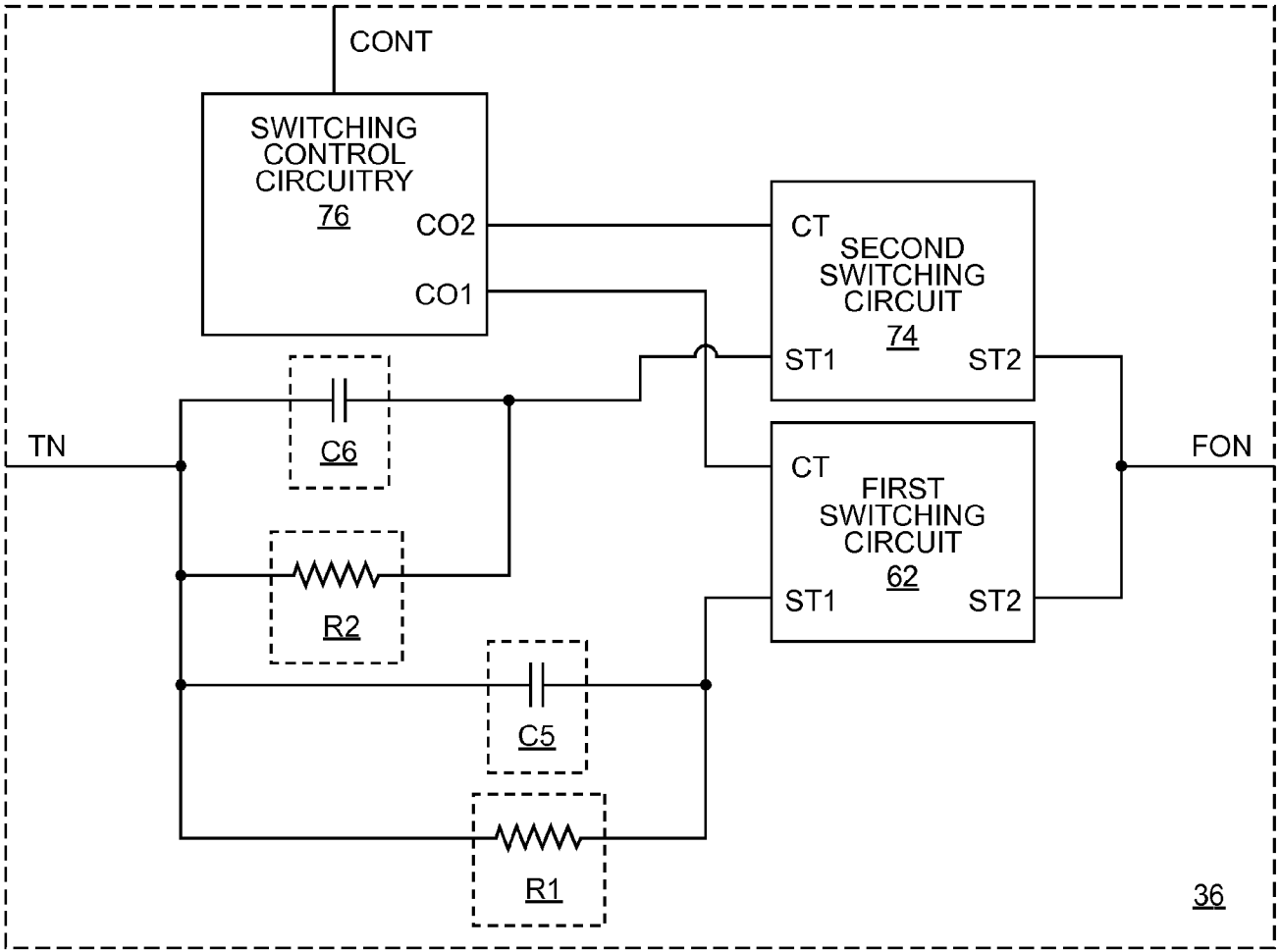
FIG. 20 shows details of the variable impedance circuit illustrated in FIG. 4, according to a thirteenth embodiment of the variable impedance circuit.

FIG. 20 shows details of the variable impedance circuit 36 illustrated in FIG. 4, according to a thirteenth embodiment of the variable impedance circuit 36. The variable impedance circuit 36 includes the first switching circuit 62 having the first switching terminal ST1, the second switching terminal ST2, and the control terminal CT, a second switching circuit 74 having a first switching terminal ST1, a second switching terminal ST2, and a control terminal CT, switching control circuitry 76 having a first control output CO1 and a second control output CO2, the first resistive element R1, the second resistive element R2, the fifth capacitive element C5, and the sixth capacitive element C6. During the first operating mode, the first switching circuit 62 has a first OPEN state, such that an open switch impedance, or very high impedance, is presented between the first and second switching terminals ST1, ST2 of the first switching circuit 62. The second switching circuit 74 has a second CLOSED state, such that a closed switch impedance, or very low impedance, is presented between the first and second switching terminals ST1, ST2 of the second switching circuit 74. During the second operating mode, the first switching circuit 62 has a first CLOSED state, such that a closed switch impedance, or very low impedance, is presented between the first and second switching terminals ST1, ST2 of the first switching circuit 62. The second switching circuit 74 has a second OPEN state, such that an open switch impedance, or very high impedance, is presented between the first and second switching terminals ST1, ST2 of the second switching circuit 74.

The first control output CO1 is coupled to the control terminal CT of the first switching circuit 62, and the second control output CO2 is coupled to the control terminal CT of the second switching circuit 74. The switching control circuitry 76 is coupled to the control node CONT. Selection of the first OPEN state or the first CLOSED state is based on a control signal, which is provided by the switching control circuitry 76, and received at the control terminal CT of the first switching circuit 62. Selection of the second OPEN state or the second CLOSED state is based on a control signal, which is provided by the switching control circuitry 76, and received at the control terminal CT of the second switching circuit 74.

The first resistive element R1 is coupled between the third node TN and the first switching terminal ST1 of the first switching circuit 62. The fifth capacitive element C5 is coupled between the third node TN and the first switching terminal ST1 of the first switching circuit 62. The sixth capacitive element C6 is coupled between the third node TN and the first switching terminal ST1 of the second switching circuit 74. The second resistive element R2 is coupled between the third node TN and the first switching terminal ST1 of the second switching circuit 74. The second switching terminal ST2 of the first switching circuit 62 is coupled to the fourth node FON. The second switching terminal ST2 of the second switching circuit 74 is coupled to the fourth node FON. During the first OPEN state and the second CLOSED state, the parallel combination of the second resistive element R2 and the sixth capacitive element C6 provides the impedance between the third node TN and the fourth node FON. During the first CLOSED state and the second OPEN state, the parallel combination of the first resistive element R1 and the fifth capacitive element C5 provides the impedance between the third node TN and the fourth node FON.

Figure 21:
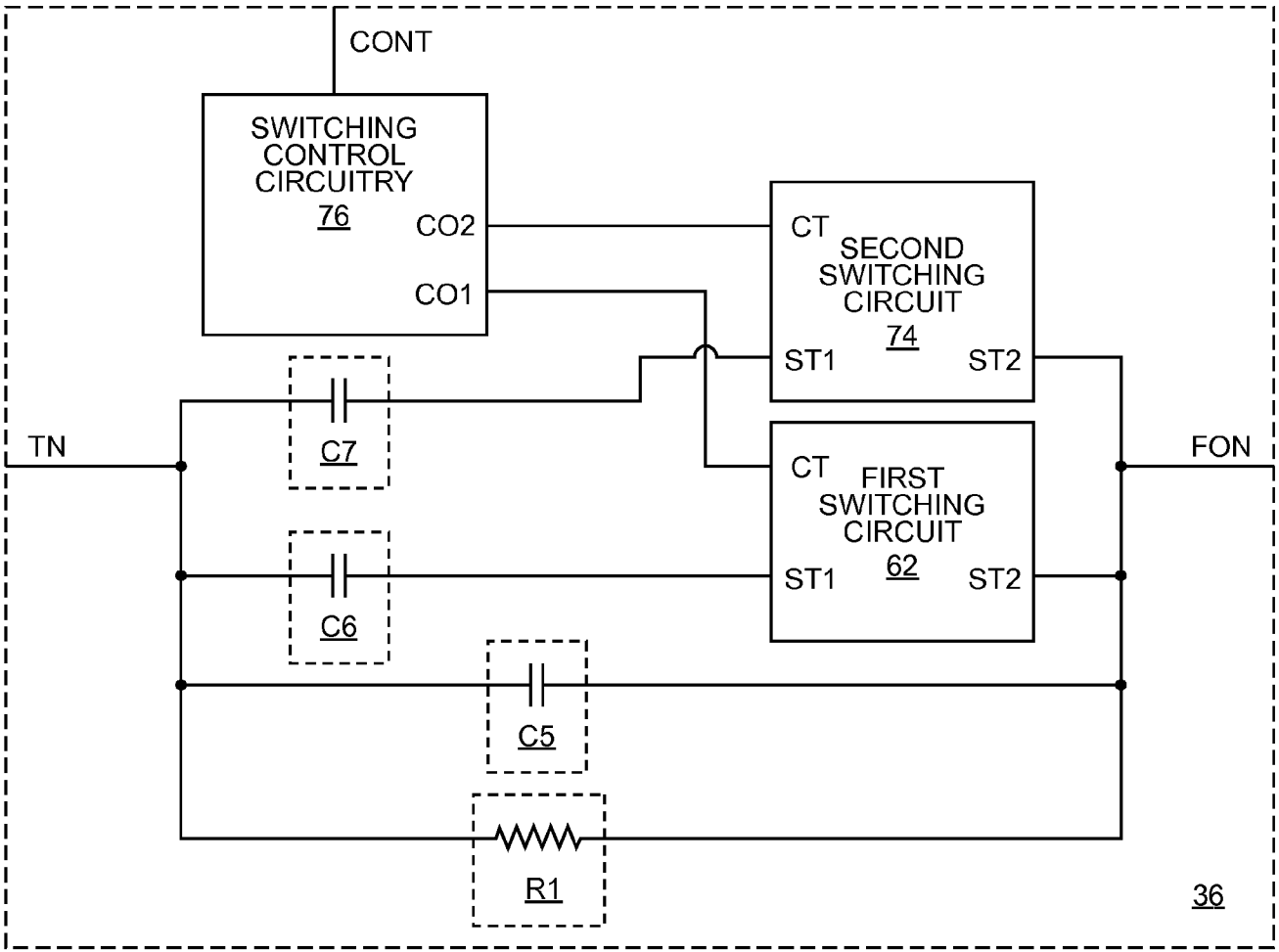
FIG. 21 shows details of the variable impedance circuit illustrated in FIG. 4, according to another embodiment of the present invention.

FIG. 21 shows details of the variable impedance circuit 36 illustrated in FIG. 4, according to another embodiment of the present invention. The frequency-adjustable RF isolator circuit 34 (not shown) operates in one of the first operating mode associated with the first notch frequency $F_{N1}$ and the first impedance presented between the third node TN and the fourth node FON, the second operating mode associated with the second notch frequency $F_{N2}$ and the second impedance presented between the third node TN and the fourth node FON, and a third operating mode associated with a third notch frequency $F_{N3}$ (not shown) and a third impedance presented between the third node TN and the fourth node FON. Each of the first, the second, and the third notch frequencies $F_{N1}$, $F_{N2}$, $F_{N3}$ may fall within a corresponding one of three separate RF communications bands. The first and the second notch frequencies $F_{N1}$, $F_{N2}$ may fall within one RF communications band and the third notch frequency $F_{N3}$ may fall within another RF communications band. The first, the second, and the third notch frequencies $F_{N1}$, $F_{N2}$, $F_{N3}$ may fall within a single RF communications band.

The variable impedance circuit 36 includes the first switching circuit 62 having the first switching terminal ST1, the second switching terminal ST2, and the control terminal CT, the second switching circuit 74 having the first switching terminal ST1, the second switching terminal ST2, and the control terminal CT, the switching control circuitry 76 having the first control output CO1 and the second control output CO2, the first resistive element R1, the fifth capacitive element C5, the sixth capacitive element C6, and a seventh capacitive element C7. During the first operating mode, the first switching circuit 62 has a first OPEN state, such that an open switch impedance, or very high impedance, is presented between the first and second switching terminals ST1, ST2 of the first switching circuit 62. The second switching circuit 74 has a second OPEN state, such that an open switch impedance, or very high impedance, is presented between the first and second switching terminals ST1, ST2 of the second switching circuit 74.

During the second operating mode, the first switching circuit 62 has a first CLOSED state, such that a closed switch impedance, or very low impedance, is presented between the first and second switching terminals ST1, ST2 of the first switching circuit 62. The second switching circuit 74 has the second OPEN state. During the third operating mode, the second switching circuit 74 has a second CLOSED state, such that a closed switch impedance, or very low impedance, is presented between the first and second switching terminals ST1, ST2 of the second switching circuit 74. The first switching circuit 62 has the first OPEN state.

The first control output CO1 is coupled to the control terminal CT of the first switching circuit 62, and the second control output CO2 is coupled to the control terminal CT of the second switching circuit 74. The switching control circuitry 76 is coupled to the control node CONT. Selection of the first OPEN state or the first CLOSED state is based on a control signal, which is provided by the switching control circuitry 76, and received at the control terminal CT of the first switching circuit 62. Selection of the second OPEN state or the second CLOSED state is based on a control signal, which is provided by the switching control circuitry 76, and received at the control terminal CT of the second switching circuit 74.

The first resistive element R1 is coupled between the third node TN and the fourth node FON. The fifth capacitive element C5 is coupled between the third node TN and the fourth node FON. The sixth capacitive element C6 is coupled between the third node TN and the first switching terminal ST1 of the first switching circuit 62. The seventh capacitive element C7 is coupled between the third node TN and the first switching terminal ST1 of the second switching circuit 74. The second switching terminal ST2 of the first switching circuit 62 is coupled to the fourth node FON. The second switching terminal ST2 of the second switching circuit 74 is coupled to the fourth node FON. During the first OPEN state and the second OPEN state, the parallel combination of the first resistive element R1 and the fifth capacitive element C5 provides the impedance between the third node TN and the fourth node FON. During the first CLOSED state and the second OPEN state, the parallel combination of the first resistive element R1, the fifth capacitive element C5, and the sixth capacitive element C6 provides the impedance between the third node TN and the fourth node FON. During the first OPEN state and the second CLOSED state, the parallel combination of the first resistive element R1, the fifth capacitive element C5, and the seventh capacitive element C7 provides the impedance between the third node TN and the fourth node FON.

Alternate embodiments of the variable impedance circuit 36 may include any number of switching circuits, any number of resistive elements, any number of capacitive elements, and any number of inductive elements coupled together in any combination.

Figure 22:
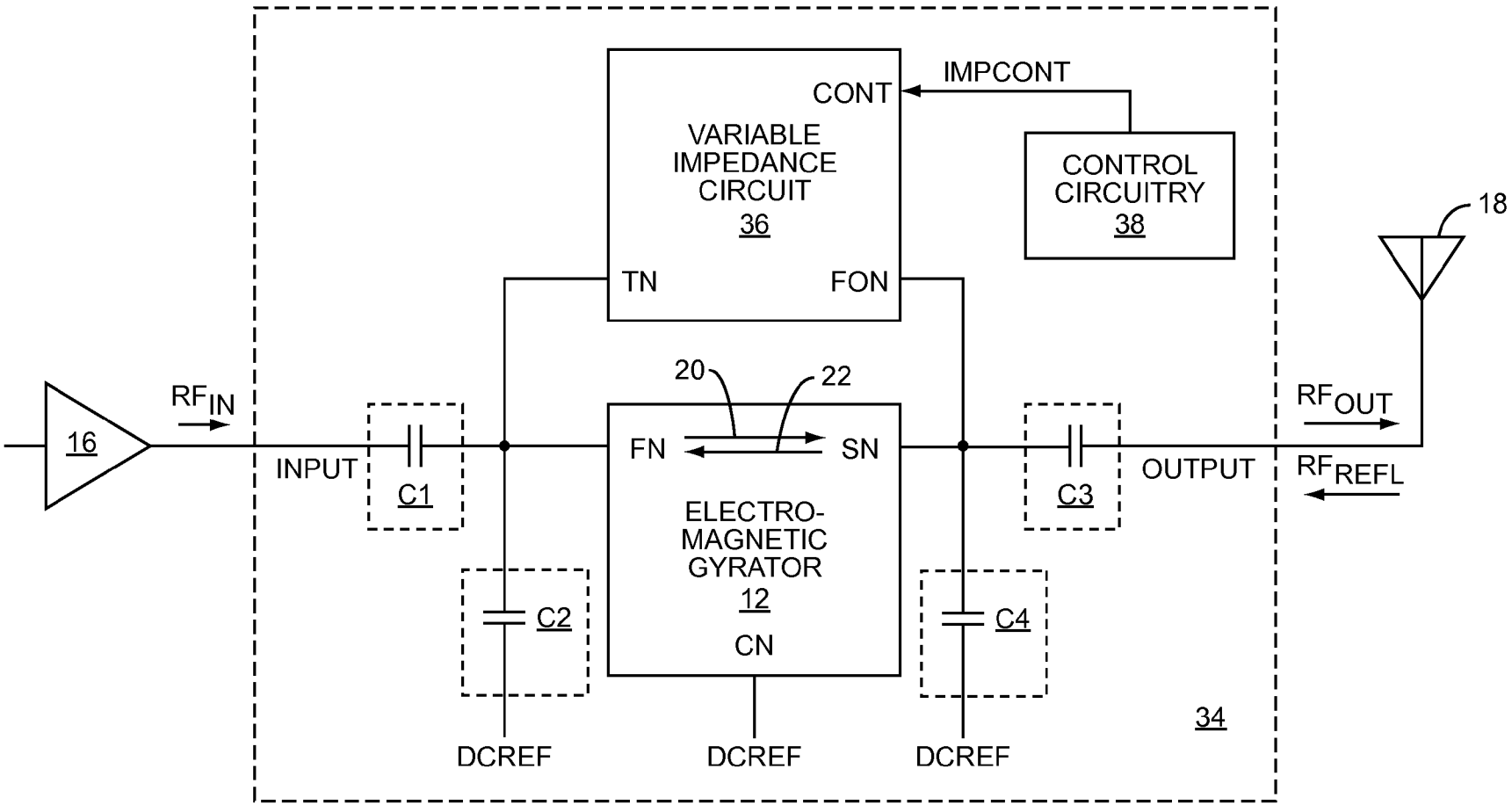
FIG. 22 shows the frequency-adjustable RF isolator circuit according to an alternate embodiment of the frequency-adjustable RF isolator circuit.

FIG. 22 shows the frequency-adjustable RF isolator circuit 34 according to an alternate embodiment of the frequency-adjustable RF isolator circuit 34. The frequency-adjustable RF isolator circuit 34 illustrated in FIG. 22 is similar to the frequency-adjustable RF isolator circuit 34 illustrated in FIG. 4, except in the frequency-adjustable RF isolator circuit 34 illustrated in FIG. 22, the common node CN, the second capacitive element C2, and the fourth capacitive element C4 are coupled to a direct current (DC) reference DCREF instead of to ground. In another embodiment of the frequency-adjustable RF isolator circuit 34, any or all of the common node CN, the second capacitive element C2, and the fourth capacitive element C4 may be coupled to ground instead of to the DC reference DCREF.

Figure 23:
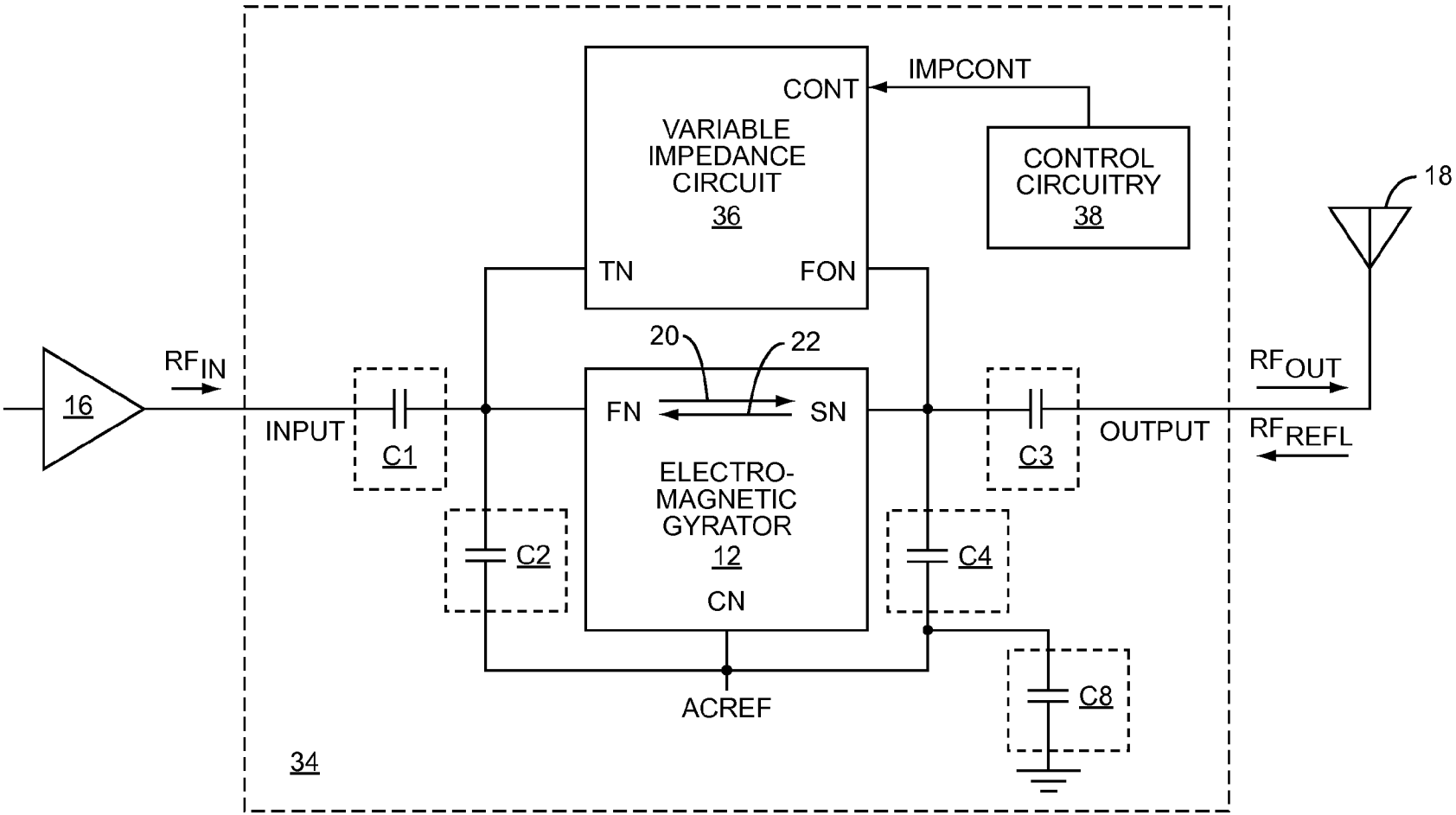
FIG. 23 shows the frequency-adjustable RF isolator circuit according to an additional embodiment of the frequency-adjustable RF isolator circuit.

FIG. 23 shows the frequency-adjustable RF isolator circuit 34 according to an additional embodiment of the frequency-adjustable RF isolator circuit 34. The frequency-adjustable RF isolator circuit 34 illustrated in FIG. 23 is similar to the frequency-adjustable RF isolator circuit 34 illustrated in FIG. 4, except in the frequency-adjustable RF isolator circuit 34 illustrated in FIG. 23, the common node CN, the second capacitive element C2, and the fourth capacitive element C4 are coupled to an alternating current (AC) reference ACREF instead of to ground. An eighth capacitive element C8 is coupled between the AC reference ACREF and ground. In another embodiment of the frequency-adjustable RF isolator circuit 34, any or all of the common node CN, the second capacitive element C2, and the fourth capacitive element C4 may be coupled to ground instead of to the AC reference ACREF, the eighth capacitive element C8 may be omitted, or any combination thereof.

Figure 24:
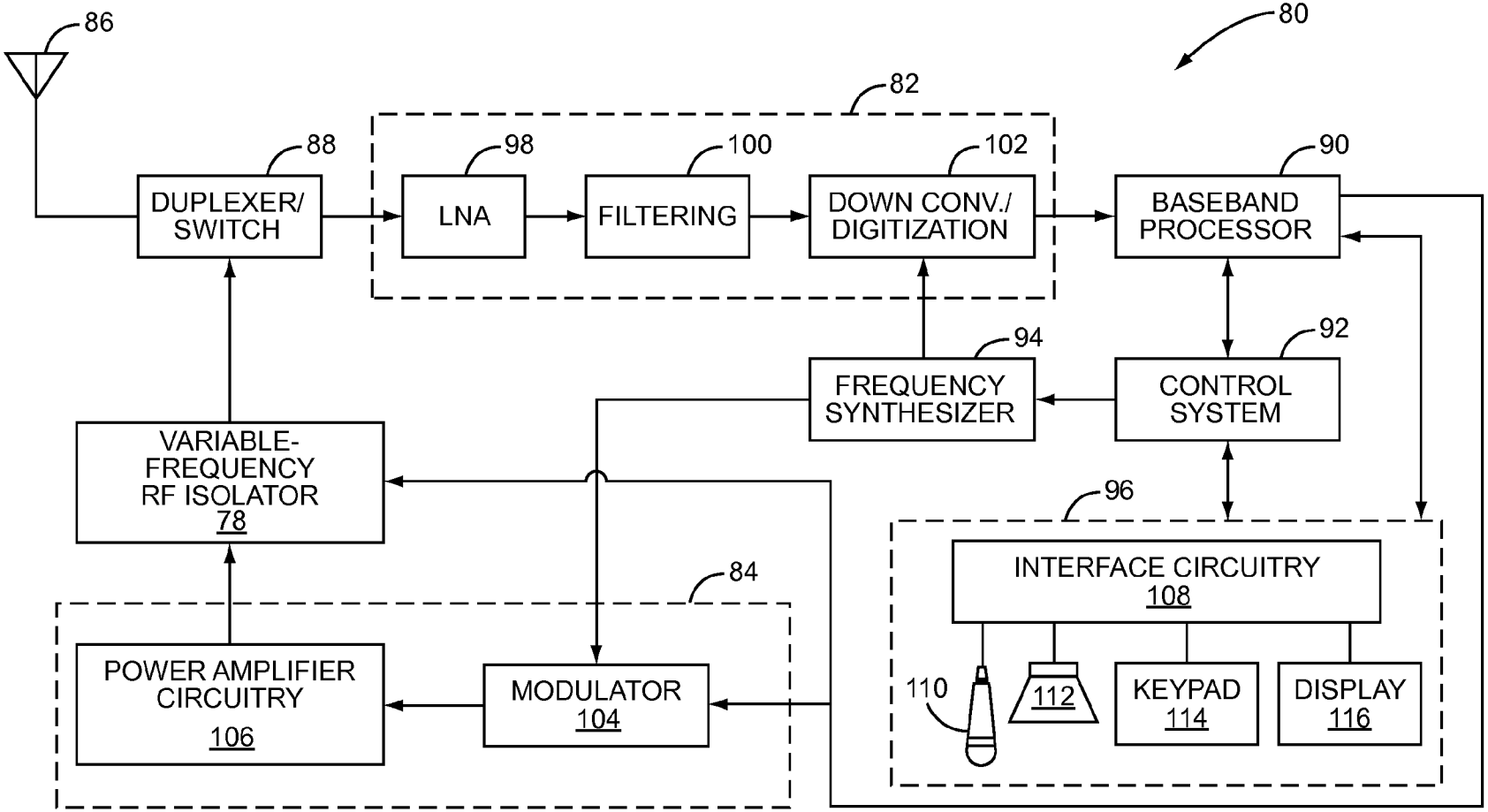
FIG. 24 shows an application example of the present invention used in a mobile terminal.

An application example of a variable-frequency RF isolator 78 is its use in a mobile terminal 80, the basic architecture of which is represented in FIG. 24. The mobile terminal 80 may include a receiver front end 82, a radio frequency transmitter section 84, an antenna 86, a duplexer or switch 88, a baseband processor 90, a control system 92, a frequency synthesizer 94, an interface 96, and the variable-frequency RF isolator 78. The receiver front end 82 receives information bearing radio frequency signals from one or more remote transmitters provided by a base station (not shown). A low noise amplifier (LNA) 98 amplifies the signal. Filtering 100 minimizes broadband interference in the received signal, while down conversion and digitization circuitry 102 down converts the filtered, received signal to an intermediate or baseband frequency signal, which is then digitized into one or more digital streams. The receiver front end 82 typically uses one or more mixing frequencies generated by the frequency synthesizer 94. The baseband processor 90 processes the digitized received signal to extract information or data bits conveyed in the received signal. This processing typically comprises demodulation, decoding, and error correction operations. As such, the baseband processor 90 is generally implemented in one or more digital signal processors (DSPs).

On the transmit side, the baseband processor 90 receives digitized data, which may represent voice, data, or control information, from the control system 92, which the baseband processor 90 encodes for transmission. The encoded data is output to the transmitter 84, where it is used by a modulator 104 to modulate a carrier signal that is at a desired transmit frequency. Power amplifier circuitry 106 amplifies the modulated carrier signal to a level appropriate for transmission, and delivers the amplified and modulated carrier signal to the antenna 86 through the variable-frequency RF isolator 78 and the duplexer or switch 88. The baseband processor 90 selects an appropriate operating mode of the variable-frequency RF isolator 78 based on the desired transmit frequency provided to the modulator 104.

A user may interact with the mobile terminal 80 via the interface 96, which may include interface circuitry 108 associated with a microphone 110, a speaker 112, a keypad 114, and a display 116. The interface circuitry 108 typically includes analog-to-digital converters, digital-to-analog converters, amplifiers, and the like. Additionally, it may include a voice encoder/decoder, in which case it may communicate directly with the baseband processor 90. The microphone 110 will typically convert audio input, such as the user's voice, into an electrical signal, which is then digitized and passed directly or indirectly to the baseband processor 90. Audio information encoded in the received signal is recovered by the baseband processor 90, and converted by the interface circuitry 108 into an analog signal suitable for driving the speaker 112. The keypad 114 and the display 116 enable the user to interact with the mobile terminal 80, input numbers to be dialed, address book information, or the like, as well as monitor call progress information. In an exemplary embodiment of the present invention, the variable-frequency RF isolator 78 is a frequency-adjustable RF isolator circuit 34.

Some of the circuitry previously described may use discrete circuitry, integrated circuitry, programmable circuitry, non-volatile circuitry, volatile circuitry, software executing instructions on computing hardware, firmware executing instructions on computing hardware, the like, or any combination thereof. The computing hardware may include mainframes, micro-processors, micro-controllers, DSPs, the like, or any combination thereof.

Those skilled in the art will recognize improvements and modifications to the preferred embodiments of the present invention. All such improvements and modifications are considered within the scope of the concepts disclosed herein and the claims that follow.

What is claimed is:

1. Radio frequency (RF) isolator circuitry comprising:

control circuitry adapted to select one of a first operating mode and a second operating mode; and a variable isolation circuit comprising:

an electro-magnetic gyrator adapted to:

substantially process a first RF signal in a forward direction by applying about zero phase-shift to the first RF signal; and substantially process a second RF signal in a reverse direction by applying a first phase-shift to the second RF signal; and a variable impedance circuit coupled to the electro-magnetic gyrator and adapted to present a first impedance to the electro-magnetic gyrator during the first operating mode and present a second impedance to the electro-magnetic gyrator during the second operating mode, the variable isolation circuit adapted to operate as a band-pass filter when processing the first RF signal, and operate as a notch filter when processing the second RF signal, such that the notch filter has a first notch frequency during the first operating mode and a second notch frequency during the second operating mode.

2. The RF isolator circuitry of claim 1 wherein the control circuitry is further adapted to select one of at least three operating modes, and the notch filter has at least three notch frequencies associated with the at least three operating modes.

3. The RF isolator circuitry of claim 1 wherein during the first operating mode, the second RF signal has about the first notch frequency and the first phase-shift is about 180 degrees, and during the second operating mode, the second RF signal has about the second notch frequency and the first phase-shift is about 180 degrees.

4. The RF isolator circuitry of claim 1 wherein the second RF signal is approximately a reflection of the first RF signal.

5. The RF isolator circuitry of claim 1 wherein:

the variable isolation circuit further comprises an input node and an output node;

the electro-magnetic gyrator comprises a first node coupled to the input node and adapted to receive the first RF signal and provide the processed second RF signal, a second node coupled to the output node and adapted to receive the second RF signal and provide the processed first RF signal, and a common node coupled to ground; and the variable impedance circuit comprises a third node coupled to the first node and a fourth node coupled to the second node, such that the first impedance is presented between the third node and the fourth node during the first operating mode, and the second impedance is presented between the third node and the fourth node during the second operating mode.

6. The RF isolator circuitry of claim 1 wherein:

the variable isolation circuit further comprises an input node and an output node;

the electro-magnetic gyrator comprises a first node coupled to the input node and adapted to receive the first RF signal and provide the processed second RF signal, a second node coupled to the output node and adapted to receive the second RF signal and provide the processed first RF signal, and a common node coupled to an alternating current (AC) reference; and the variable impedance circuit comprises a third node coupled to the first node and a fourth node coupled to the second node, such that the first impedance is presented between the third node and the fourth node during the first operating mode, and the second impedance is presented between the third node and the fourth node during the second operating mode.

7. The RF isolator circuitry of claim 5 wherein the electro-magnetic gyrator comprises:

an RF core, which during the first operating mode and the second operating mode has a static magnetic field;

a first inductive element substantially encircling a first region of the RF core and coupled between the first node and the second node; and a second inductive element substantially encircling a second region of the RF core and coupled between the common node and the second node.

8. The RF isolator circuitry of claim 5 wherein the variable impedance circuit further comprises a first resistive element coupled between the third node and the fourth node, and a first capacitive element coupled between the third node and the fourth node.

9. The RF isolator circuitry of claim 5 wherein the variable impedance circuit further comprises a first inductive element coupled between the third node and the fourth node.

10. The RF isolator circuitry of claim 5 wherein the variable impedance circuit further comprises a first switching element, wherein the first switching element is in an OPEN state during the first operating mode and the first switching element is in a CLOSED state during the second operating mode.

11. The RF isolator circuitry of claim 10 wherein the variable impedance circuit comprises a first resistive element coupled in series with the first switching element.

12. The RF isolator circuitry of claim 10 wherein the variable impedance circuit comprises a first capacitive element coupled in series with the first switching element.

13. The RF isolator circuitry of claim 10 wherein the variable impedance circuit comprises a first inductive element coupled in series with the first switching element.

14. The RF isolator circuitry of claim 5 wherein the variable impedance circuit further comprises a varactor diode element, wherein the varactor diode element has a first reverse bias voltage during the first operating mode, and the varactor diode element has a second reverse bias voltage during the second operating mode.

15. The RF isolator circuitry of claim 1 wherein the first impedance comprises a first resistance, and the second impedance comprises a second resistance.

16. The RF isolator circuitry of claim 1 wherein the first impedance comprises a first capacitive reactance, and the second impedance comprises a second capacitive reactance.

17. The RF isolator circuitry of claim 1 wherein:

during the first operating mode and at the first notch frequency, a return loss, which is associated with processing RF signals in the reverse direction, is at least three decibels greater than an insertion loss, which is associated with processing RF signals in the forward direction; and during the second operating mode and at the second notch frequency, the return loss is at least three decibels greater than the insertion loss.

18. The RF isolator circuitry of claim 17 wherein during the first operating mode and at the first notch frequency, the return loss is at least ten decibels greater than the insertion loss, and during the second operating mode and at the second notch frequency, the return loss is at least ten decibels greater than the insertion loss.

19. The RF isolator circuitry of claim 1 wherein the first notch frequency is in a first RF band and the second notch frequency is in a second RF band, such that the first RF band does not overlap the second RF band.

20. The RF isolator circuitry of claim 1 wherein the first notch frequency and the second notch frequency are both a single RF band.

21. The RF isolator circuitry of claim 1 wherein the first notch frequency is about equal to a center frequency of a first RF channel, and the second notch frequency is about equal to a center frequency of a second RF channel.

22. A method comprising:

selecting one of a first operating mode and a second operating mode;

providing a variable isolation circuit, which comprises an electro-magnetic gyrator and a variable impedance circuit coupled to the electro-magnetic gyrator;

substantially processing a first RF signal in a forward direction by applying about zero phase-shift to the first RF signal;

substantially processing a second RF signal in a reverse direction by applying a first phase-shift to the second RF signal;

presenting a first impedance to the electro-magnetic gyrator during the first operating mode; and presenting a second impedance to the electro-magnetic gyrator during the second operating mode, wherein the variable isolation circuit is adapted to operate as a bandpass filter when processing the first RF signal, and operate as a notch filter when processing the second RF signal, such that the notch filter has a first notch frequency during the first operating mode and a second notch frequency during the second operating mode.

* * * * *